US011749050B2

(12) United States Patent
Chou et al.

(10) Patent No.: US 11,749,050 B2
(45) Date of Patent: Sep. 5, 2023

(54) SHEET PROCESSING APPARATUS

(71) Applicant: Masterwork Automodules Tech Corp. Ltd., Taipei (TW)

(72) Inventors: Hung-Hsun Chou, Taipei (TW); Wen-Hsien Tsai, Taipei (TW)

(73) Assignee: MASTERWORK AUTOMODULES TECH CORP. LTD., Taipei (TW)

( * ) Notice: Subject to any disclaimer, the term of this patent is extended or adjusted under 35 U.S.C. 154(b) by 578 days.

(21) Appl. No.: 16/901,936

(22) Filed: Jun. 15, 2020

(65) Prior Publication Data

US 2020/0410805 A1 Dec. 31, 2020

(30) Foreign Application Priority Data

Jun. 25, 2019 (TW) ..... 108122223

(51) Int. Cl.

| | |
|---|---|
| ***G07D 11/40*** | (2019.01) |
| ***G07D 11/18*** | (2019.01) |
| ***G07D 11/14*** | (2019.01) |
| ***G07D 11/235*** | (2019.01) |

(52) U.S. Cl.

CPC ..... *G07D 11/40* (2019.01); *G07D 11/14* (2019.01); *G07D 11/18* (2019.01); *G07D 11/235* (2019.01); *G07D 2211/00* (2013.01)

(58) Field of Classification Search

CPC ..... G07D 11/40; G07D 11/14; G07D 11/18; G07D 11/235; G07D 2211/00; B65H 29/125; B65H 2301/3122; B65H 2301/3125; B65H 2402/60; B65H 29/006; B65H 2402/10; B65H 2404/1544; B65H 2405/332; B65H 2601/324; B65H 2701/1912; B65H 29/58; G07F 19/202; G07F 19/203; G07F 19/209

See application file for complete search history.

(56) References Cited

U.S. PATENT DOCUMENTS 6,315,279 B1 * 11/2001 Minamishin ..... G07F 19/20 271/302
2006/0219516 A1 * 10/2006 Saltsov ..... G07F 19/20 194/207

(Continued)

FOREIGN PATENT DOCUMENTS

JP H05-182048 A 7/1993

OTHER PUBLICATIONS

Search Report issued to European counterpart application No. 20181759.0 by the EPO dated Nov. 24, 2020 (18 pages).

*Primary Examiner* — Jeffrey A Shapiro
(74) *Attorney, Agent, or Firm* — McClure, Qualey & Rodack, LLP

(57) ABSTRACT

A sheet processing apparatus includes first and second sheet processing modules, a connecting module, and a storage module. In each of the first and second sheet processing modules, a sheet received from an entrance port is identified by an identifying unit, and if the sheet is qualified, the sheet is transported to a first communication port through a first transport path. In the connecting module, a first diverter mechanism is configured to permit sheet transport between a second communication port and a selected one of the first and second sheet processing modules. The storage module is disposed for receiving and storing the sheet from the connecting module.

1 Claim, 26 Drawing Sheets

(56) References Cited

U.S. PATENT DOCUMENTS

| | | | | |
|---|---|---|---|---|
| 2007/0095897 | A1* | 5/2007 | Carpenter | G06Q 20/108 235/379 |
| 2010/0072220 | A1* | 3/2010 | Michels | B65H 29/006 221/71 |
| 2012/0119433 | A1* | 5/2012 | Peters | B65H 1/04 271/18 |
| 2014/0069769 | A1* | 3/2014 | Kobayashi | G07D 11/12 194/206 |

* cited by examiner

SHEET PROCESSING APPARATUS

CROSS-REFERENCE TO RELATED APPLICATION

This application claims priority from Taiwanese invention patent application no. 108122223, filed on Jun. 25, 2019.

FIELD

The disclosure relates to a sheet processing apparatus, more particularly to a sheet processing apparatus with detachable sheet processing modules.

BACKGROUND

A conventional automated teller machine (ATM) includes a single sheet processing module, and a user can only draw cash from the sheet processing module or deposit money into the sheet processing module at a specific side of the ATM. In this regard, a user cannot access the ATM at different sides thereof.

Besides, the sheet processing module is fixed inside a machine casing. When repairing or troubleshooting the sheet processing module, a maintenance staff has to open the machine casing to treat the sheet processing module in a limited space. Therefore, the maintenance of the conventional ATM is inconvenient and time-wasting.

SUMMARY

Therefore, an object of the disclosure is to provide a novel sheet processing apparatus which may overcome at least one drawback of the prior art.

According to the disclosure, the sheet processing apparatus includes a first sheet processing module, a second sheet processing module, a connecting module, and a storage module. The first and second sheet processing modules are reversely arranged, each of the first and second sheet processing modules includes a main frame assembly and an identifying unit. The main frame assembly defines an entrance port for receiving a sheet, a first communication port, and a first transport path for transporting the sheet received from the entrance port to the first communication port. The identifying unit is disposed to identify the sheet on the first transport path for admission of the sheet qualified by the identifying unit to the first communication port. The connecting module is configured for connecting the first and second sheet processing modules in such a manner that at least one of the first and second sheet processing modules is detachably mounted on the connecting module. The connecting module includes a connecting frame assembly and a first diverter mechanism. The connecting frame assembly defines a first interconnection port, a second interconnection port, and a second communication port. Each of the first and second interconnection ports is disposed to receive the sheet from the first communication port of a respective one of the first and second sheet processing modules. The first diverter mechanism is mounted to the connecting frame assembly, and is configured to permit sheet transport between the second communication port and a selected one of the first and second interconnection ports. The storage module defines a third interconnection port for receiving the sheet from the second communication port, and a storage space for storing the sheet received from the third interconnection port.

BRIEF DESCRIPTION OF THE DRAWINGS

Other features and advantages of the disclosure will become apparent in the following detailed description of the embodiment(s) with reference to the accompanying drawings, in which.

DETAILED DESCRIPTION

Figure 1:
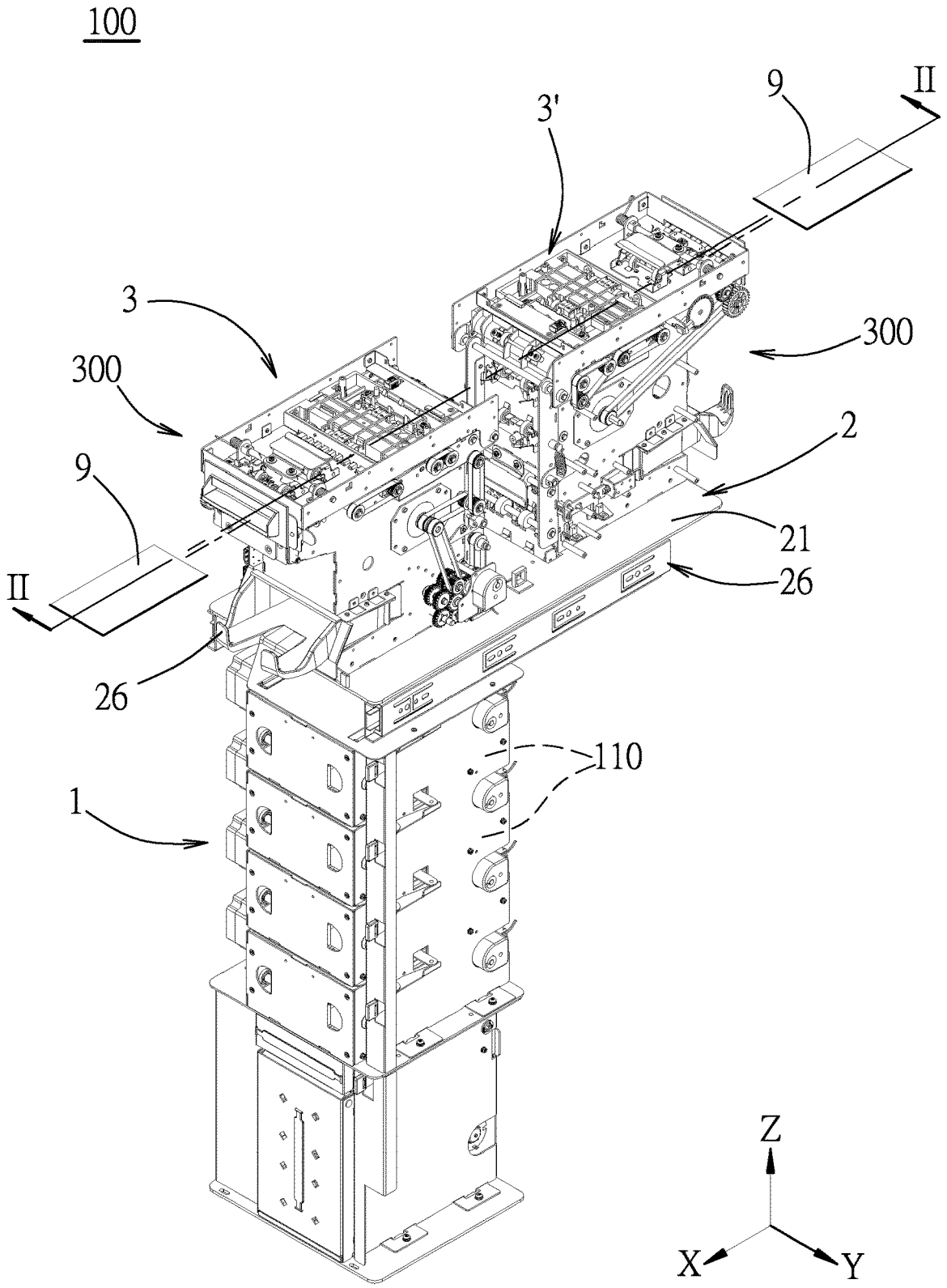
FIG. 1 is a perspective view of a sheet processing apparatus according to a first embodiment of the disclosure, illustrating an assembling relationship among a storage module, a connecting module, and first and second sheet processing modules.

Before the disclosure is described in greater detail, it should be noted that where considered appropriate, reference numerals have been repeated among the figures to indicate corresponding or analogous elements, which may optionally have similar characteristics.

FIG. 1 is perspective view of a sheet processing apparatus 100 according to a first embodiment of the disclosure which may be applied inside a machine casing of an automated teller machine (ATM). In the first embodiment, the sheet processing apparatus 100 is exemplified as a withdraw and deposit machine for drawing and depositing of a sheet 9, and the sheet 9 is exemplified as a rectangular banknote. Of course, the sheet 9 may be a bank check, a game ticket, etc. The sheet processing apparatus 100 includes a storage module 1, a connecting module 2, a first sheet processing module 3, and a second sheet processing module 3'. The first and second sheet processing modules 3, 3' are reversely arranged in a front-and-rear direction (X) on the connecting module 2. The connecting module 2 is disposed above the storage module 1 and is configured for connecting the first and second sheet processing modules 3, 3' in such a manner that at least one of the first and second sheet processing modules 3, 3' is detachably mounted on the connecting module 2.

Figure 20:
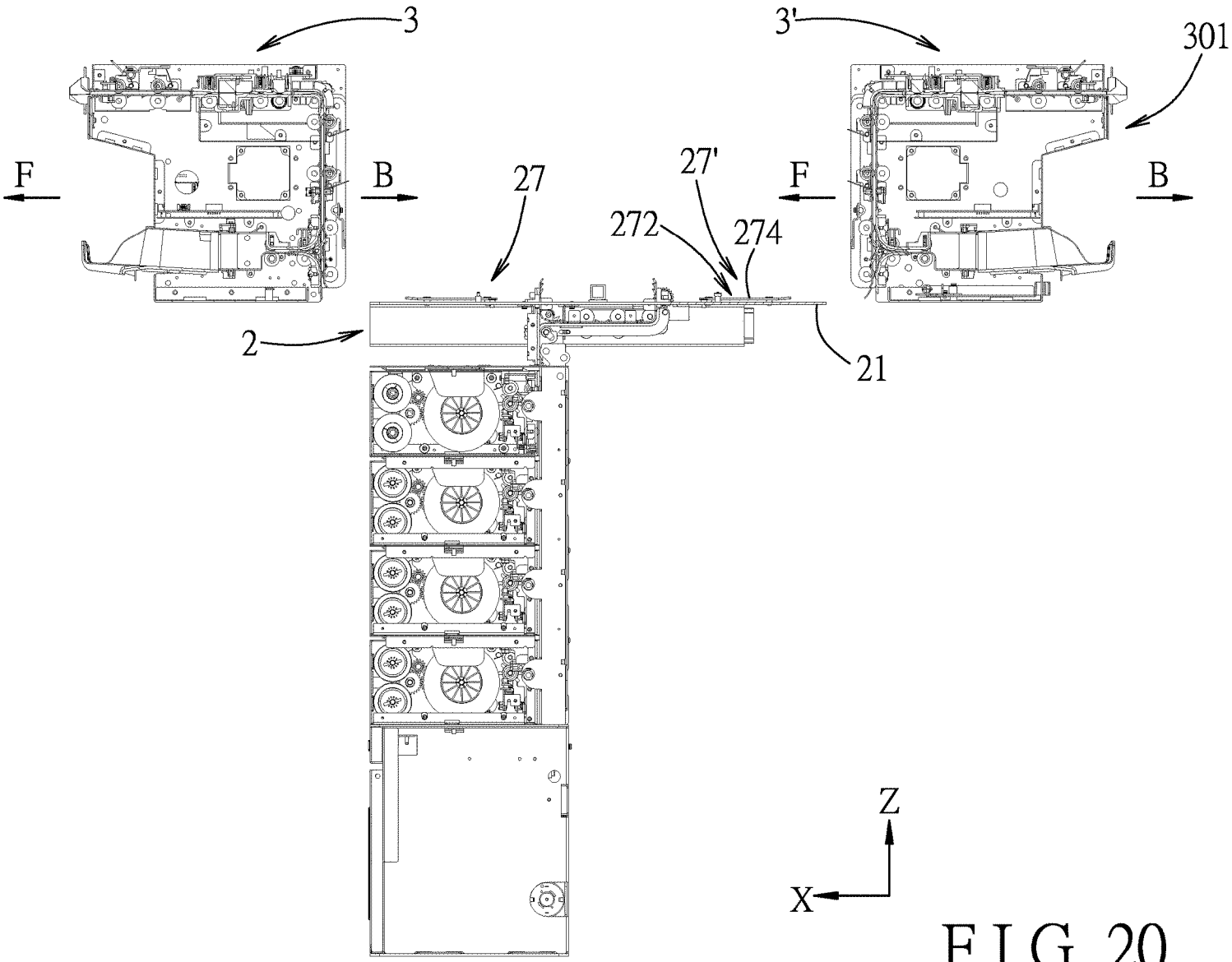
FIG. 20 is similar to FIG. 2 but illustrating the first and second sheet processing modules detached oppositely from the connecting module.

In an embodiment shown in FIG. 20, the first and second sheet processing modules 3, 3' may have the same height in an upright direction (Z), and are configured to be detachable respectively from two opposite sides of the connecting module 2 in the front-and-rear direction (X). The first sheet processing module 3 may be configured to be forwardly slidable for detaching from a front side of the connecting module 2. The second sheet processing module 3' may be configured to be rearwardly slidable for detaching from a rear side of the connecting module 2. Each of the first and second sheet processing modules 3, 3' has an operating side 301 and a back side 302 opposite to the operating side 301. The back sides 302 of the first and second sheet processing modules 3, 3' may be disposed to face each other on the connecting module 2.

Referring back to FIG. 2, it is shown that each of the first and second sheet processing modules 3, 3' includes a main frame assembly 300 and an identifying unit 30. The main frame assembly 300 defines an entrance port (T12) for receiving the sheet 9, a first communication port (T13), and a first transport path (T11) for transporting the sheet 9 received from the entrance port (T12) to the first communication port (T13). The identifying unit 30 is disposed to identify the sheet 9 on the first transport path (T11) for admission of the sheet 9 qualified by the identifying unit 30 to the first communication port (T13). In an embodiment shown in FIG. 2, the entrance port (T12) is disposed at the operating side 301 for receiving the sheet 9.

Figure 2:
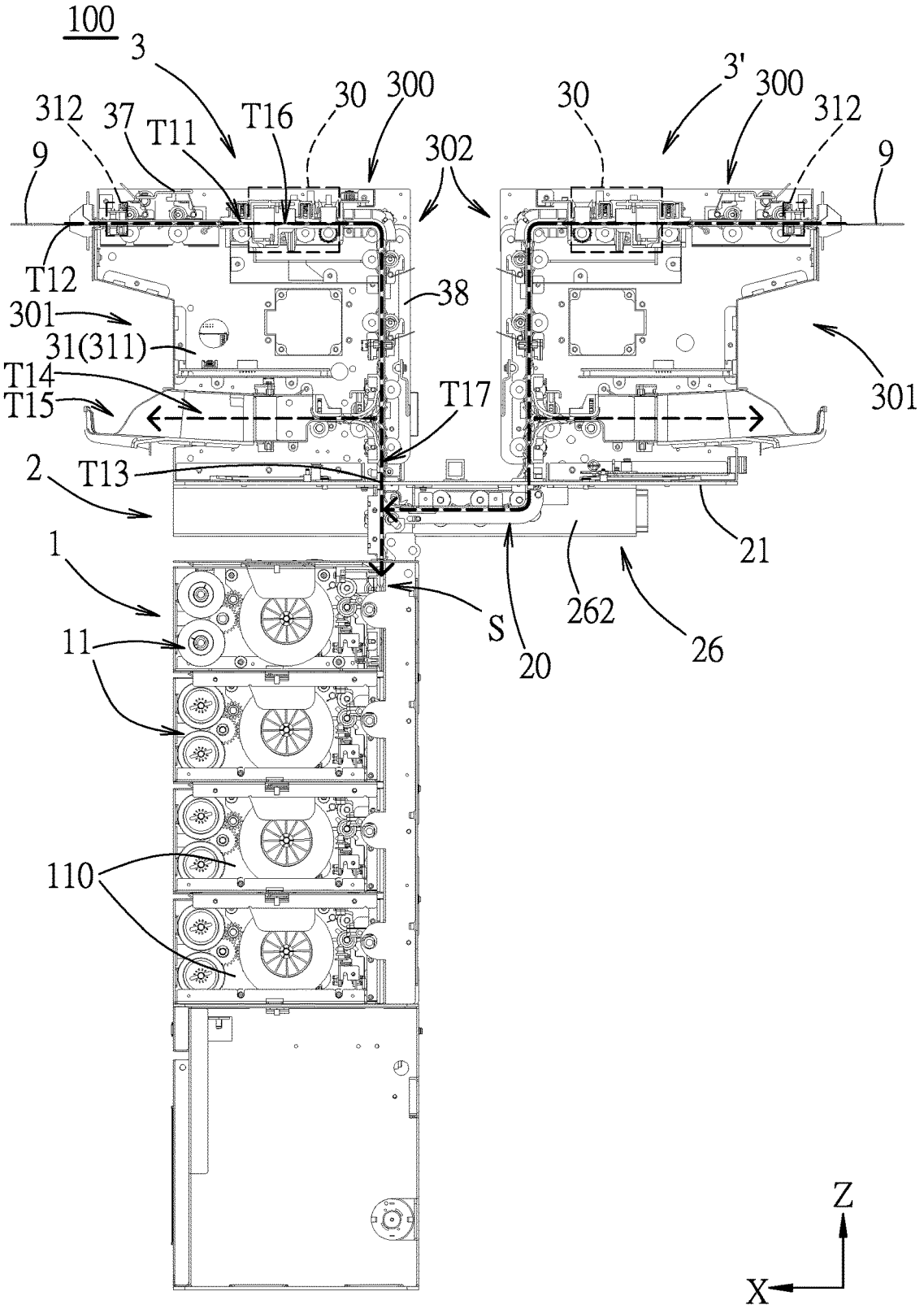
FIG. 2 is a cross-sectional view taken along line II-II of FIG. 1, illustrating a supporting plate of the connecting module in a retracted position.
Figure 9:
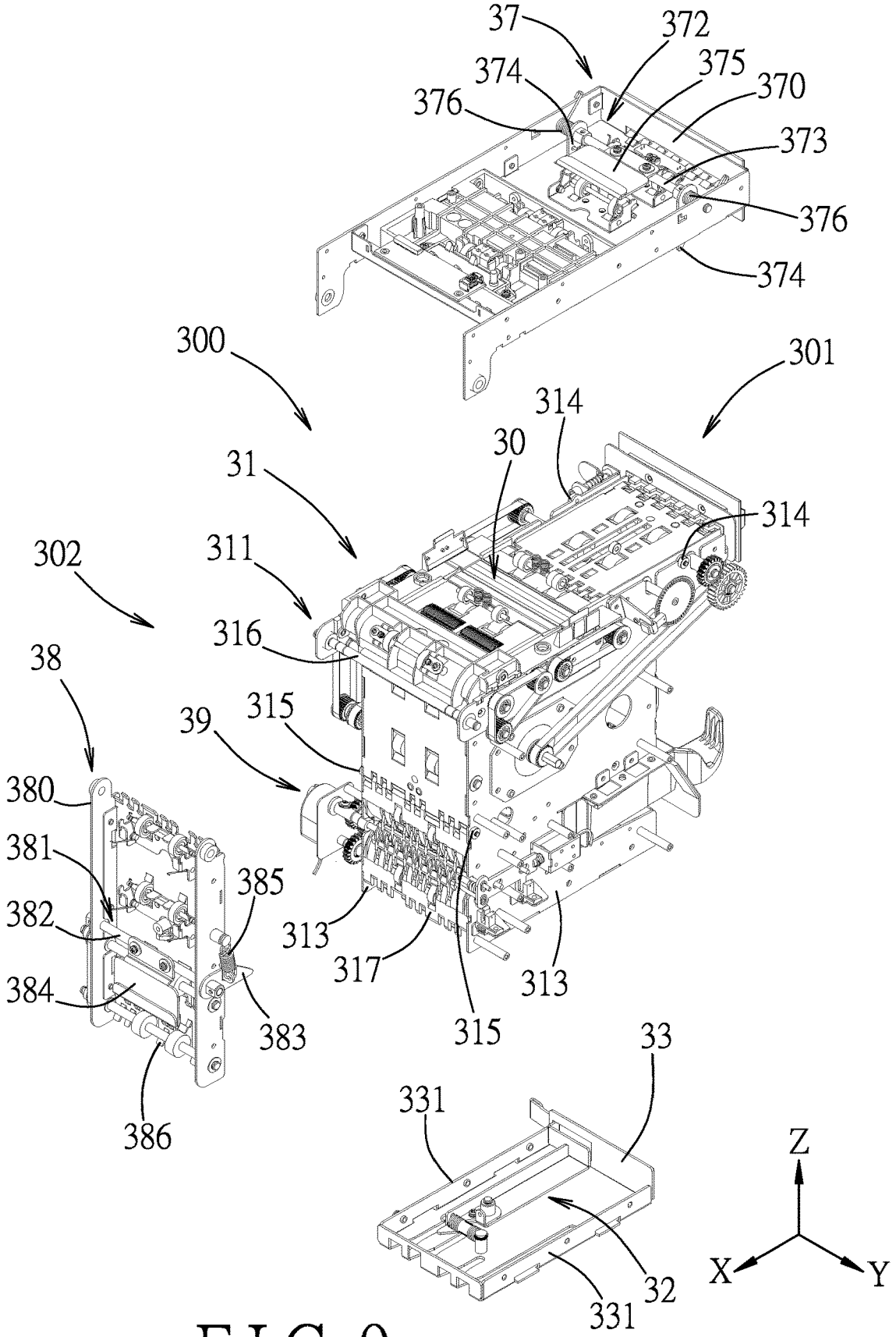
FIG. 9 is an exploded perspective view of one of the first and second sheet processing modules of the first embodiment, illustrating an assembling relationship among a main frame assembly with upper and back fastening mechanisms, and a locking mechanism.

In an embodiment shown in FIGS. 2 and 9, the main frame assembly 300 may include a main frame 31, a top frame unit 37, and a back frame unit 38 for cooperatively defining the first transport path (T11), the entrance port (T12), and the first communication port (T13).

The main frame 31 has a main body 311 with two side plates 313, a pair of first protuberances 314, a pair of second protuberances 315, and a pivot axle 316. The side plates 313 are opposite to each other in a left-and-right direction (Y). The first protuberances 314 are mounted respectively on the side plates 313 in proximity to the operating side 301 and a top side of the side plates 313. The second protuberances 315 are respectively mounted on the side plates 313 in proximity to the back side 302 and a bottom side of the side plates 313. The pivot axle 316 extends in the left-and-right direction (Y) to interconnect the side plates 313 in proximity to the back side 302.

As shown in FIGS. 2 and 9, the top frame unit 37 includes a top frame 370 and an upper fastening mechanism 372. The top frame 370 is hingedly mounted to the pivot axle 316 of the main frame 31 to cover a top side of the main frame 31 so as to permit the main frame 31 and the top frame 370 to define therebetween the entrance port (T12) and an upper horizontal portion of the first transport path (T11). In an embodiment shown in FIG. 2, the identifying unit 30 may be disposed between the main frame 31 and the top frame 370 for identifying the sheet 9.

The upper fastening mechanism 372 is configured to lock the top frame 370 to the main frame 31, and to be acceptable to release the lock between the main and top frames 31, 370 to permit turning of the top frame 370 relative to the main frame 31 to thereby open the upper portion of the first transport path (T11).

In an embodiment shown in FIG. 9, the upper fastening mechanism 372 may include an upper axle 373, a pair of upper hook members 374, an upper release plate 375, and a pair of upper torsion springs 376. The upper axle 373 is turnably mounted on the top frame 370 and extends in the left-and-right direction (Y). The upper hook members 374 are separately fixed and sleeved on the upper axle 373 to turn therewith. When the top frame 370 is locked to the main frame 31 through the upper fastening mechanism 372, each of the upper hook members 374 is hooking engagement with a respective one of the first protuberances 314 (see FIG. 12). The upper release plate 375 is screw-fastened to the upper axle 373. When the upper release plate 375 is actuated by a maintenance staff, the upper hook members 374 are driven to turn with the upper axle 373 to thereby release the hooking engagement with first protuberances 314. Each of the upper torsion springs 376 is sleeved on the upper axle 373, and has two ends which are respectively coupled to the top frame 370 and the respective upper hook member 374 so as to bias the respective upper hook member 374 to an upper fastening position, where each of the upper hook members 374 is permitted to be brought into hooking engagement with the respective first protuberance 314.

As shown in FIGS. 2 and 9, the back frame unit 38 includes a back frame 380 and a back fastening mechanism 381. The back frame 380 is hingedly mounted to the pivot axle 316 of the main frame 31 to cover a backside of the main frame 31 so as to permit the main frame 31 and the back frame 380 to define therebetween the first communication port (T13) and a lower vertical portion of the first transport path (T11). Bottom ends of the main and back frames 31, 380 define the first communication port (T13). The back fastening mechanism 381 is configured to lock the back frame 380 to the main frame 31, and to be acceptable to release the lock between the main and back frames 31, 380 to permit turning of the back frame 380 relative to the main frame 31 to thereby open the lower vertical portion of the first communication port (T11).

In an embodiment shown in FIG. 9, the back fastening mechanism 381 may include a back axle 382, a pair of back hook members 383 (only one is shown), a back release plate 384, and a pair of back extension springs 385 (only one is shown). The back axle 382 is turnably mounted on the back frame 380 and extends in the left-and-right direction (Y). The back hook members 383 are separately fixed and sleeved on the back axle 382 to turn therewith. When the back frame 380 is locked to the main frame 31 through the back fastening mechanism 381, each of the back hook members 383 is in hooking engagement with a respective one of the second protuberances 315 (see FIG. 12). The back release plate 384 is screw-fastened to the back axle 382. When the back release plate 384 is actuated by the maintenance staff, the back hook members 383 are driven to turn with the back axle 382 to thereby release the hooking engagement with second protuberances 315. Each of the back extension springs 385 has two ends which are respectively connected to the back frame 380 and the respective back hook member 383 so as to bias the respective back hook member 383 to a back fastening position, where each of the back hook members 383 is permitted to be brought into hooking engagement with the respective second protuberances 315.

Figure 4:
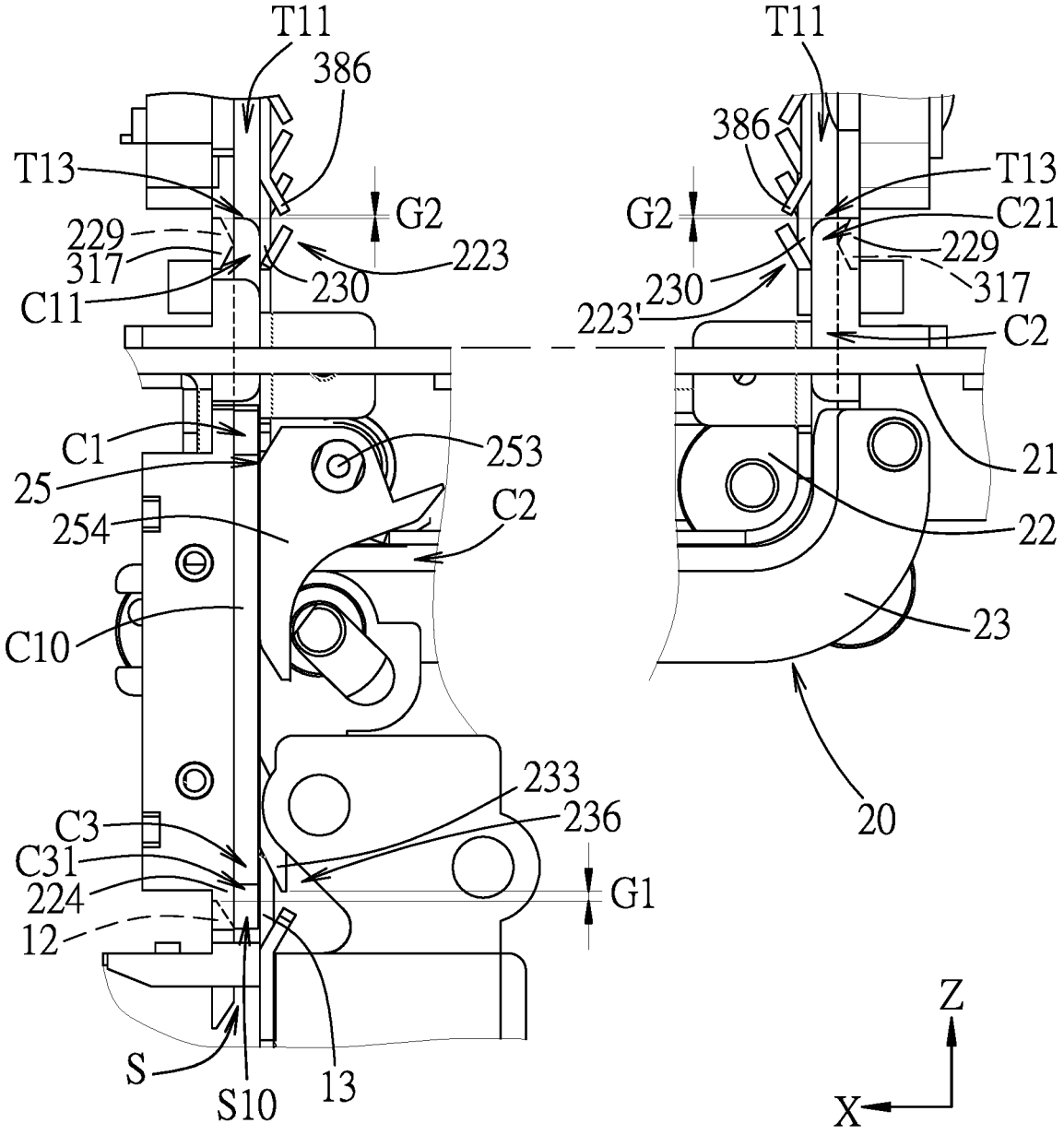
FIG. 4 is a fragmentary side view of the first embodiment, illustrating a diverter block in a first block position, a first gap defined between a bottom edge of a first vertical guide wall and a top edge of a first lower transport guide, and a second gap defined between a bottom edge of a back transport guide and a top edge of a first upper transport guide.

In an embodiment shown in FIGS. 4 and 9, the back frame 380 of the back frame unit 38 may include a back transport guide 386 which is disposed in proximity to the back side 302 to border a bottom portion of the first transport path (T11), and which has a bottom portion in the form of guiding teeth that are displaced from each other in the left-and-right direction (Y). The main frame 311 of the main frame unit 31 may further include an inner transport guide 317 which is disposed between the side plates 313 and inwardly of the back transport guide 386 to be spaced apart from the back transport guide 386 in the front-and-rear direction (X). A bottom edge of the inner transport guide 317 is disposed lower than a bottom edge of the back transport guide 386 to cooperatively define the first communication port (T13). A bottom portion of the inner transport guide 317 is in the form of guiding teeth which are displaced from each other in the left-and-right direction (Y).

Figure 14:
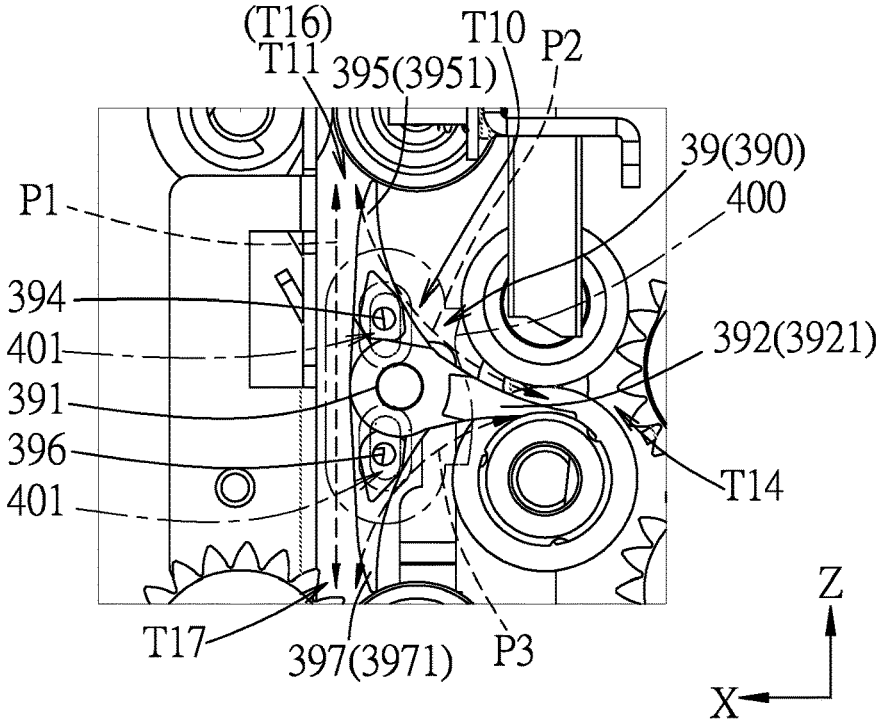
FIG. 14 is a fragmentary side view of one of the first and second sheet processing modules in the first embodiment, illustrating the second diverter mechanism in a first state.

In an embodiment shown in FIGS. 2 and 14, the main frame assembly 300 further defines a discharge transport path (T14) with a discharge port (T15) at a downstream side of the discharge transport path (T14). The discharge transport path (T14) is defined by the main body 311, and is connected to an upper juncture zone (T10) between a first transport portion (T16) and a second transport portion (T17) of the first transport path (T11). The first transport portion (T16) extends from the entrance port (T12) to the upper juncture zone (T10), and the second transport portion (T17) extends from the first communication port (T13) to the upper juncture zone (T10). As shown in FIG. 2, the identifying unit 30 is disposed to identify the sheet 9 on the first transport portion (T16). If the sheet 9 is disqualified by the identifying unit 30, the sheet 9 is permitted to be transported to the discharge port (T15) through the discharge transport path (T14). Therefore, a user can receive the disqualified sheet 9 from the operating side 301.

Figure 13:
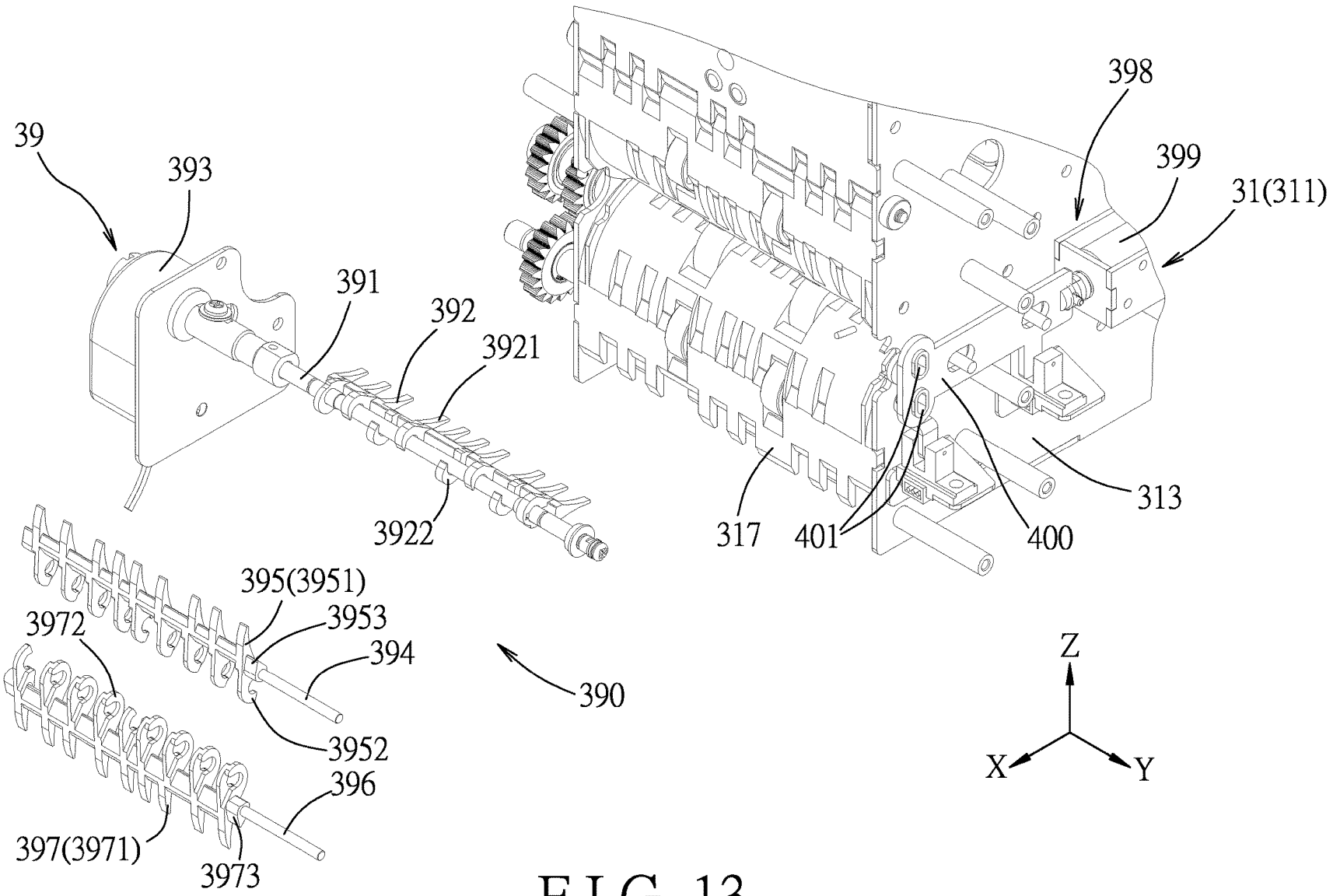
FIG. 13 is a fragmentary, exploded, perspective view of one of the first and second sheet processing modules in the first embodiment, illustrating detailed structures of a second diverter mechanism.
Figure 15:
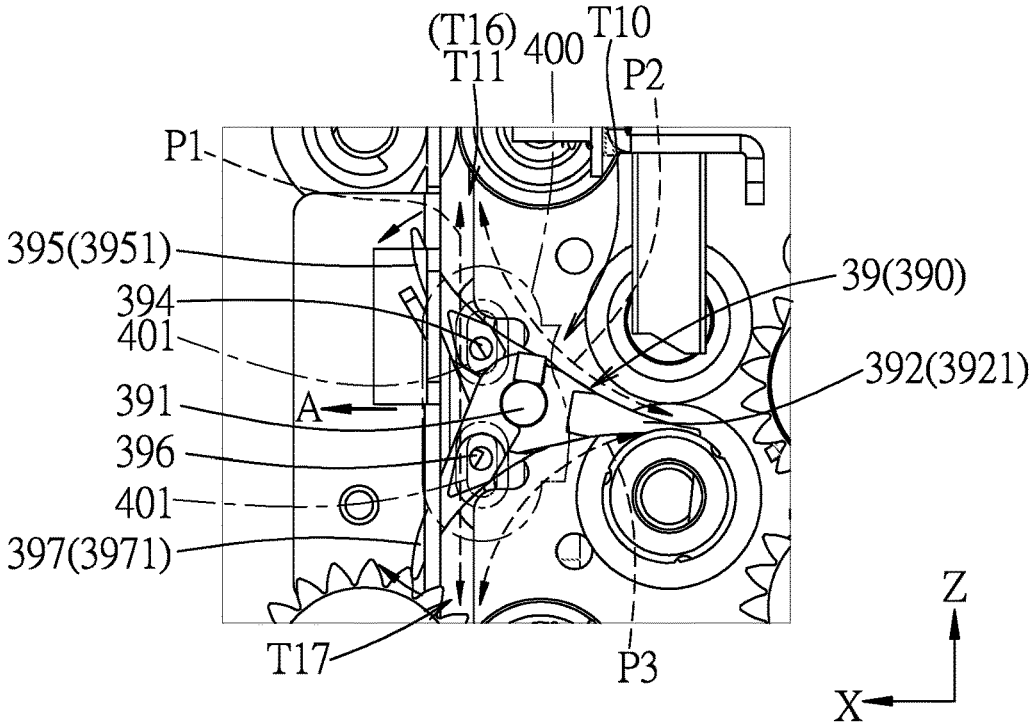
FIG. 15 is similar to FIG. 14, but illustrating the second diverter mechanism in a second state.
Figure 16:
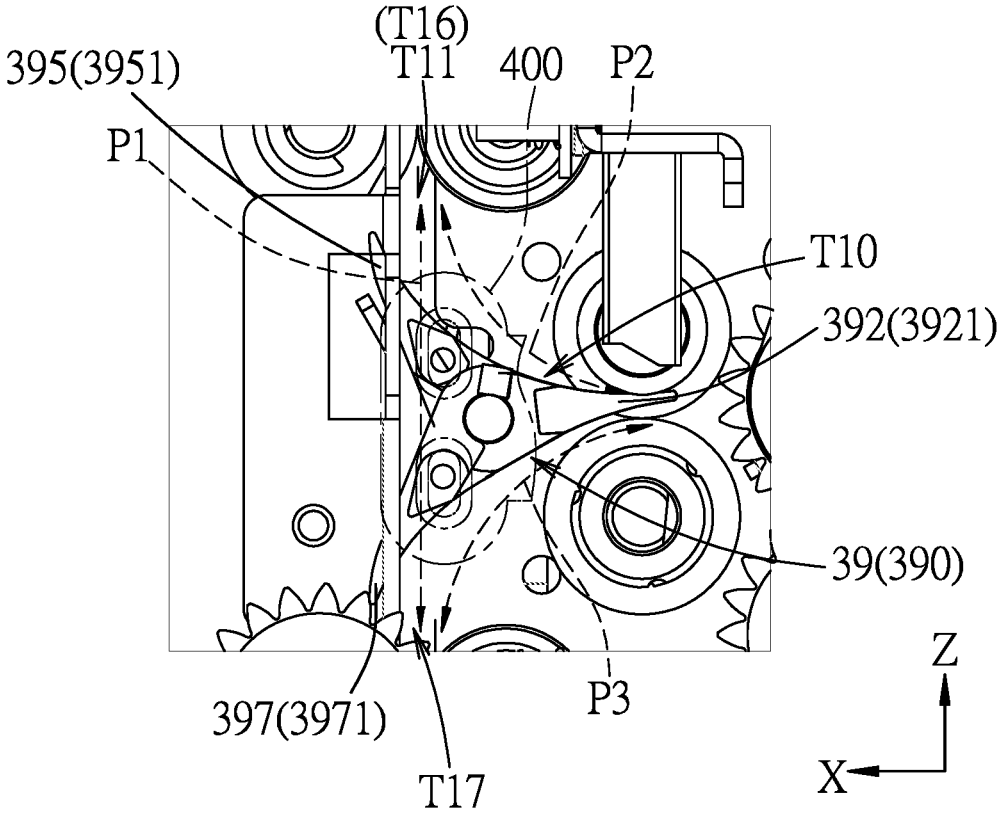
FIG. 16 is similar to FIG. 14, but illustrating the second diverter mechanism in a third state.

In an embodiment shown in FIGS. 13 and 14, each of the first and second sheet processing modules 3, 3' further includes a second diverter mechanism 39 which is mounted to the main frame assembly 300, and which has a diverter unit 390 disposed in the upper juncture zone (T10) to define a first passage (P1) for sheet transport between the first and second transport portions (T16, T17), a second passage (P2) for sheet transport between the first transport portion (T16) and the discharge path (T14), and a third passage (P3) for sheet transport between the second transport portion (T17) and the discharge path (T14). The diverter unit 390 includes a first diverter block 392 which is disposed to block a selected one of the second and third passages (P2, P3), a second diverter block 395 which is disposed to block a selected one of the first and second passages (P1, P2), and a third diverter block 397 which is disposed to block a selected one of the first and third passages (P1, P3). The diverter unit 390 is switchable among a first state, a second state, and a third state. In the first state, as shown in FIG. 14, the second and third diverter blocks 395, 397 are disposed to respectively block the second and third passages (P2, P3) to thereby open the first passage (P1). In the second state, as shown in FIG. 15, the first diverter block 392 is disposed to block the third passage (P3), and the second and third diverter blocks 395, 397 are disposed to block the first passage (P1) to thereby open the second passage (P2). In the third state, as shown in FIG. 16, the first diverter block 392 is disposed to block the second passage (P2), and the second and third diverter blocks 395, 397 are disposed to block the first passage (P1) to thereby open the third passage (P3).

In an embodiment shown in FIGS. 13 and 14, the second diverter mechanism 39 may further include a first driver unit 393 and a second driver unit 398, and the diverter unit 390 may further include a first rotary shaft 391, a second rotary shaft 394, and a third rotary shaft 396. The first rotary shaft 391 extends axially in the left-and-right direction (Y) to terminate at two ends which are pivotally connected to the side plates 313, respectively. The first diverter block 392 extends in the left-and-right direction (Y) and includes an inner block end 3921 for insertion into the discharge path (T14), and an outer mounting end 3922 which is opposite to the inner block end 3921 in the front-and-rear direction (X), and which is secured to the first rotary shaft 391 to turn therewith so as to permit the inner block end 3921 to block the second passage (P2) or the third passage (P3). The first driver unit 393 may be, for example, a solenoid switch, and is coupled to one of the ends of the first rotary shaft 391 so as to drive the turning of the first rotary shaft 391 to thereby permit the first diverter block 392 to block the second passage (P2) or the third passage (P3). The second rotary shaft 394 extends axially in the left-and-right direction (Y), and is disposed above the first rotary shaft 391. The second diverter block 395 extends in the left-and-right direction (Y) and includes an upper block end 3951 which is configured for blocking the first passage (P1) or the second passage (P2), a lower hinged end 3952 which is configured to be hingedly connected to the first rotary shaft 391, and a middle mounting region 3953 which is disposed between the upper block end 3951 and the lower hinged end 3952, and which is sleeved on and secured to the second rotary shaft 394. The third rotary shaft 396 extends axially in the left-and-right direction (Y) and is disposed beneath the first rotary shaft 391. The third diverter block 397 extends in the left-and-right direction (Y) and includes a lower block end 3971 which is configured for blocking the first passage (P1) or the third passage (P3), an upper hinged end 3972 which is configured to be hingedly connected to the first rotary shaft 391, and a middle mounting region 3973 which is disposed between the lower block end 3971 and the upper hinged end 3972, and which is sleeved on and secured to the third rotary shaft 396. The second driver unit 398 includes a driver 399 and a linkage 400. The driver 399 may be, for example, a solenoid switch, and is mounted on an outside surface of one of the side plates 313. The linkage 400 has two end segments, one of which is coupled to be driven by the driver 399 to permit linear movement of the linkage 400 in the front-and-rear direction (X) between a first position and a second position, and the other of which is formed with two slots 401 that are spaced apart from each other in the upright direction (Z), and that are configured for extension of outer ends of the second and third rotary shafts 394, 396, respectively. Each of the slots 401 is elongated in the upright direction (Z). When the linkage 400 is in the first position (see FIG. 14), the second and third rotary shafts 394, 396 are distal from each other, and the upper block end 3951 of the second diverter block 395 and the lower block end 3971 of the third diverter block 397 are disposed to block the second and third passages (P2, P3), respectively. When the linkage 400 is driven by the driver 399 to move along an arrow (A) shown in FIG. 15 from the first position (FIG. 14), the outer ends of the second and third rotary shafts 394, 396 are driven to slide respectively in the slots 401 to permit the second and third rotary shafts 394, 396 to move toward each other so as to force the upper block end 3951 of the second diverter block 395 and the lower block end 3971 of the third diverter block 397 to swing toward each other. When the linkage 400 reaches the second position (see FIG. 15), the second and third rotary shafts 394, 396 are disposed closer to each other, and the upper block end 3951 of the second diverter block 395 and the lower block end 3971 of the third diverter block 397 are disposed to block the first passage (P1).

Therefore, when the diverter unit 390 is in the first state (FIG. 14), the linkage 400 is in the first position, the second and third passages (P2, P3) are respectively blocked by the second and third diverter blocks 395, 397, and the first passage (P1) is opened. As such, the sheet 9 (such as a true banknote) qualified by the identifying unit 30 can be transported through the first passage (P1) to a first transport channel (C1) or a second transport channel (C2) of the connecting module 2. When the diverter unit 390 is in the second state (FIG. 15), the linkage 400 is in the second position, the first passage (P1) is blocked by the second and third diverter blocks 395, 397, the third passage (P3) is blocked by the first diverter block 392, and the second passage (P2) is opened. As such, the sheet 9 (such as a fake banknote) disqualified by the identifying unit 30 can be transported through the second passage (P2) to be discharged from the discharge port (T15) shown in FIG. 2. When the diverter unit 390 is in the third state (FIG. 16), the linkage 400 is in the second position, the first passage (P1) is blocked by the second and third diverter blocks 395, 397, the second passage (P2) is blocked by the first diverter block 392, and the third passage (P3) is opened. As such, the sheet 9 inside the storage module 1 can be transported to the first communication port (T13) through the first transport channel (C1) or the second transport channel (C2), and then be transported through the third passage (P3) and the discharge transport path (T14) to thereby be drawn out by a user from the discharge port (T15).

In an embodiment shown in FIG. 2, each of the first and second sheet processing modules 3, 3' may further include a triggering sensor 312 which is disposed on the first transport path (T11) in proximity to the entrance port (T12) for detecting entrance of the sheet 9 from the entrance port (T12), and which is in signal communication with a first diverter mechanism 25 (described below) of the connecting module 2 such that when entrance of the sheet 9 is detected by the trigger sensor 312 of one of the first and second sheet processing modules 3, 3', a diverter block 254 (described below) of the first diverter mechanism 25 is switched to a corresponding one of a first block position and a second block position (described below) so as to permit the connecting module 2 to receive the sheet 9 from the one of the first and second sheet processing modules 3, 3'.

Figure 5:
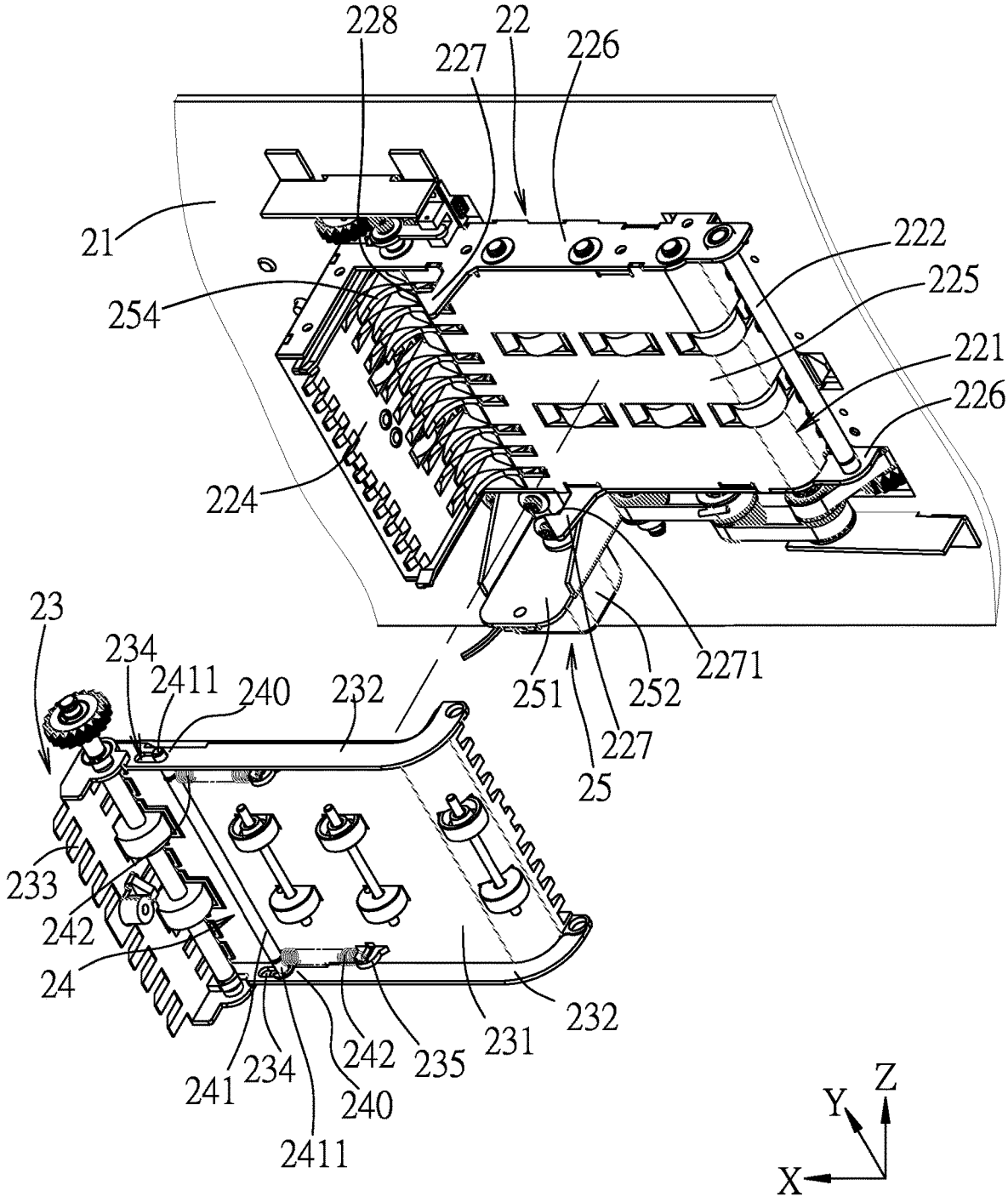
FIG. 5 is a fragmentary, exploded, perspective view of the first embodiment, illustrating an assembling relationship between an upper frame unit and a lower frame unit.

As shown in FIGS. 2, 4, and 5, the connecting module 2 includes a connecting frame assembly 20 and the diverter mechanism 25 mentioned above. The connecting frame assembly 20 defines a first interconnection port (C11), a second interconnection port (C21), and a second communication port (C31). Each of the first and second interconnection ports (C11, C21) is disposed to receive the sheet 9 from the first communication port (T13) of a respective one of the first and second sheet processing modules 3, 3'. The first diverter mechanism 25 is mounted to the connecting frame assembly 20 and is configured to permit sheet transport between the second communication port (C31) and a selected one of the first and second interconnection ports (C11, C21).

Figure 8:
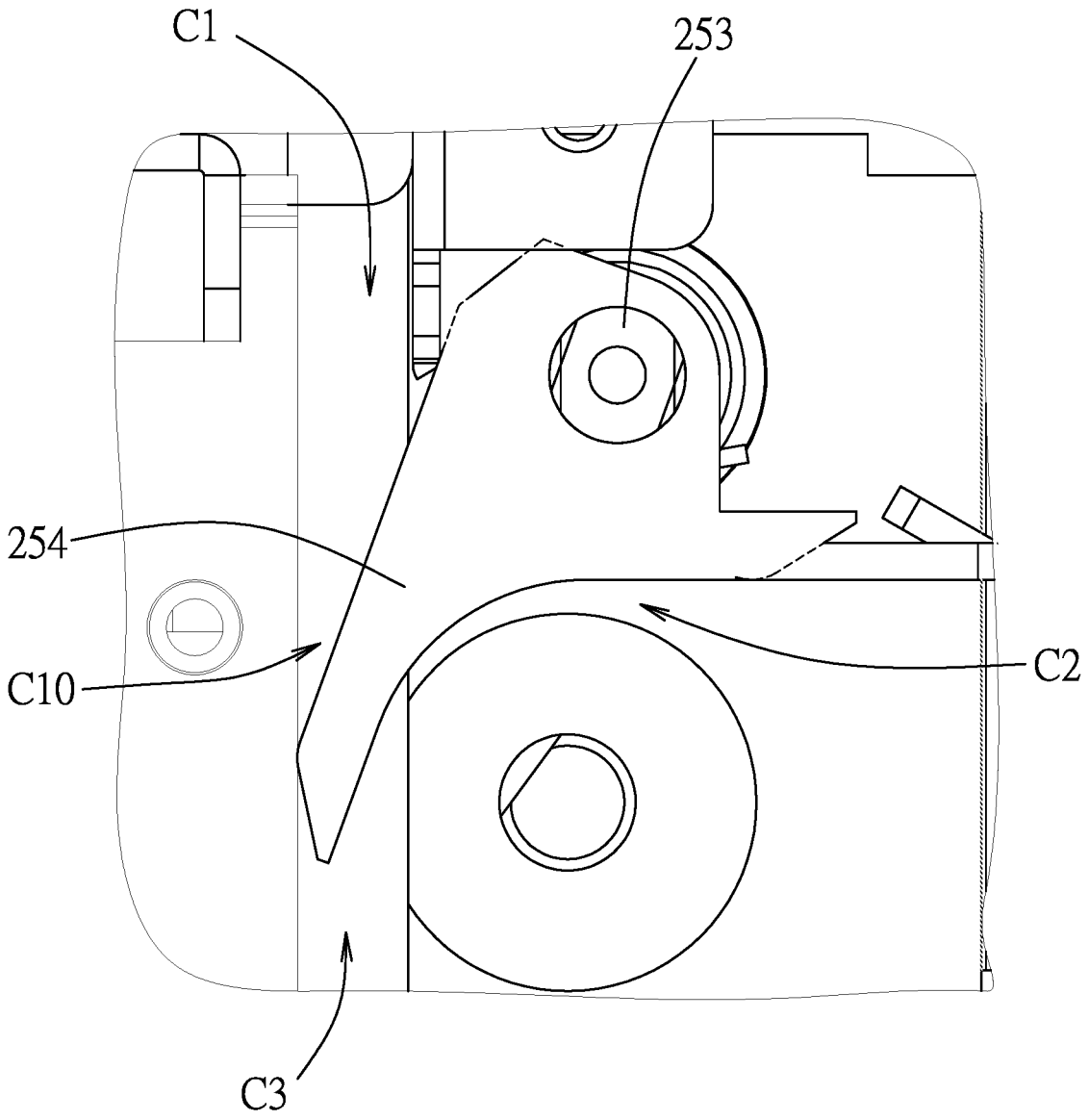
FIG. 8 is a fragmentary side view of the connecting module of the first embodiment, illustrating the diverter block in a second block position.

In an embodiment shown in FIG. 4, the connecting frame assembly 20 may further define a lower juncture zone (C10), the first transport channel (C1), the second transport channel (C2), and a third transport channel (C3). Each of the first and second transport channels (C1, C2) extends from a respective one of the first and second interconnection ports (C11, C21) to the lower juncture zone (C10). The third transport channel (C3) extends from the second communication port (C31) to the lower juncture zone (C10). In addition, the first diverter mechanism 25 may include the diverter block 254 (mentioned above) which is disposed in the lower juncture zone (C10), and which is switchable between the first and second block positions (mentioned above). In the first block position, as shown in FIG. 4, the diverter block 254 is disposed to block the second transport channel (C2) to permit sheet transport between the first and third transport channels (C1, C3). In the second block position, as shown in FIG. 8, the diverter block 254 is disposed to block the first transport channel (C1) to permit sheet transport between the second and third transport channels (C2, C3).

Figure 7:
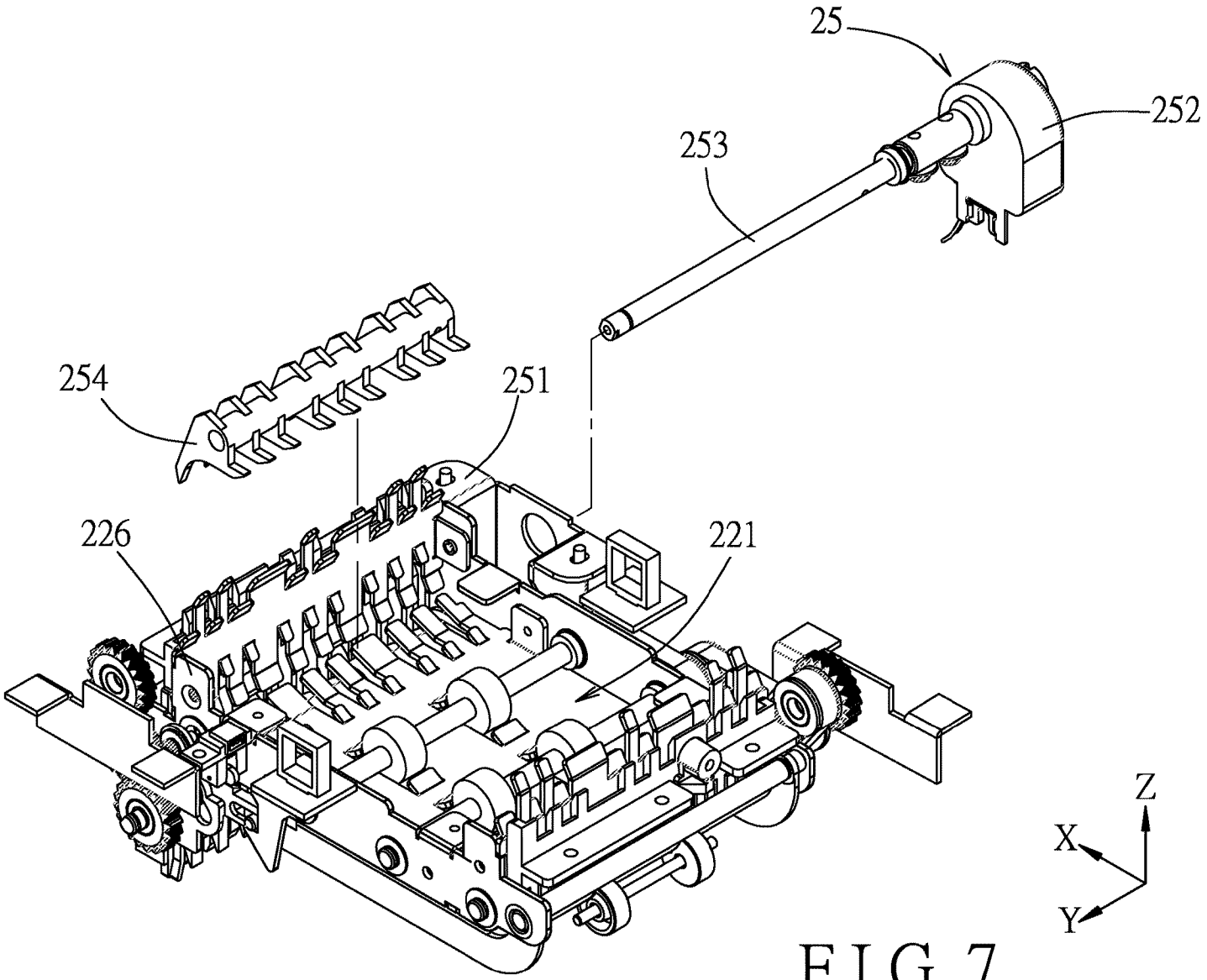
FIG. 7 is a fragmentary, exploded, perspective view of the connecting module of the first embodiment, illustrating an assembling relationship among a driver, a rotary shaft, and the diverter block.

In an embodiment shown in FIGS. 4, 5, and 7, the first diverter mechanism 25 may further include a supporting frame 251, a driver 252, and a rotary shaft 253. The supporting frame 251 may be, for example, screw-fixed to a downward surface of a supporting plate 21 (described below). The driver 252 may be, for example, a solenoid switch, and is fixed to the supporting frame 251. The rotary shaft 253 has an end coupled to be driven by the driver 252 to permit turning of the rotary shaft 253. The diverter block 254 is sleeved on and secured to the rotary shaft 253 to turn therewith, and the rotary shaft 253 and the diverter block 254 are disposed in the lower juncture zone (C10). When the driver 252 is actuated, the diverter block 254 is permitted to switch between the first block position (FIG. 4) and the second block position (FIG. 8).

In an embodiment shown in FIGS. 2 and 5, the triggering sensor 312 of each of the first and second sheet processing modules 3, 3' is electrically connected to the driver 252 of the first diverter mechanism 25. If the triggering sensor 312 of the first sheet processing module 3 detects the entrance of the sheet 9 from the entrance port (T12) to generate a first signal, a circuit control module (not shown) will receive the first signal and transmit a second signal to the driver 252. If the diverter block 254 is not in the first block position, the driver 252 will drive the diverter block 254 to switch to the first block position. As such, the sheet 9 received by the first sheet processing module 3 can be transported to the storage module 1 through the first and third transport channels (C1, C3). If the triggering sensor 312 of the second sheet processing module 3' detects the entrance of the sheet 9 from the entrance port (T12) to generate a third signal, the non-shown circuit control module will receive the third signal and transmit a fourth signal to the driver 252. If the diverter block 254 is not in the second block position, the driver 252 will drive the diverter block 254 to switch to the second block position. As such, the sheet 9 received by the second sheet processing module 3' can be transported to the storage module 1 through the second and third transport channels (C2, C3).

It should be noted that during the transport of the sheet 9 from the first sheet processing module 3 to the connecting module 2, if another user inserts a sheet 9 into the second sheet processing module 3' to generate the third signal, the non-shown circuit control module will not emit the fourth signal until the sheet 9 in the first sheet processing module 3 is transported to the storage module 1 or is discharged from the discharge port (T15).

Figure 3:
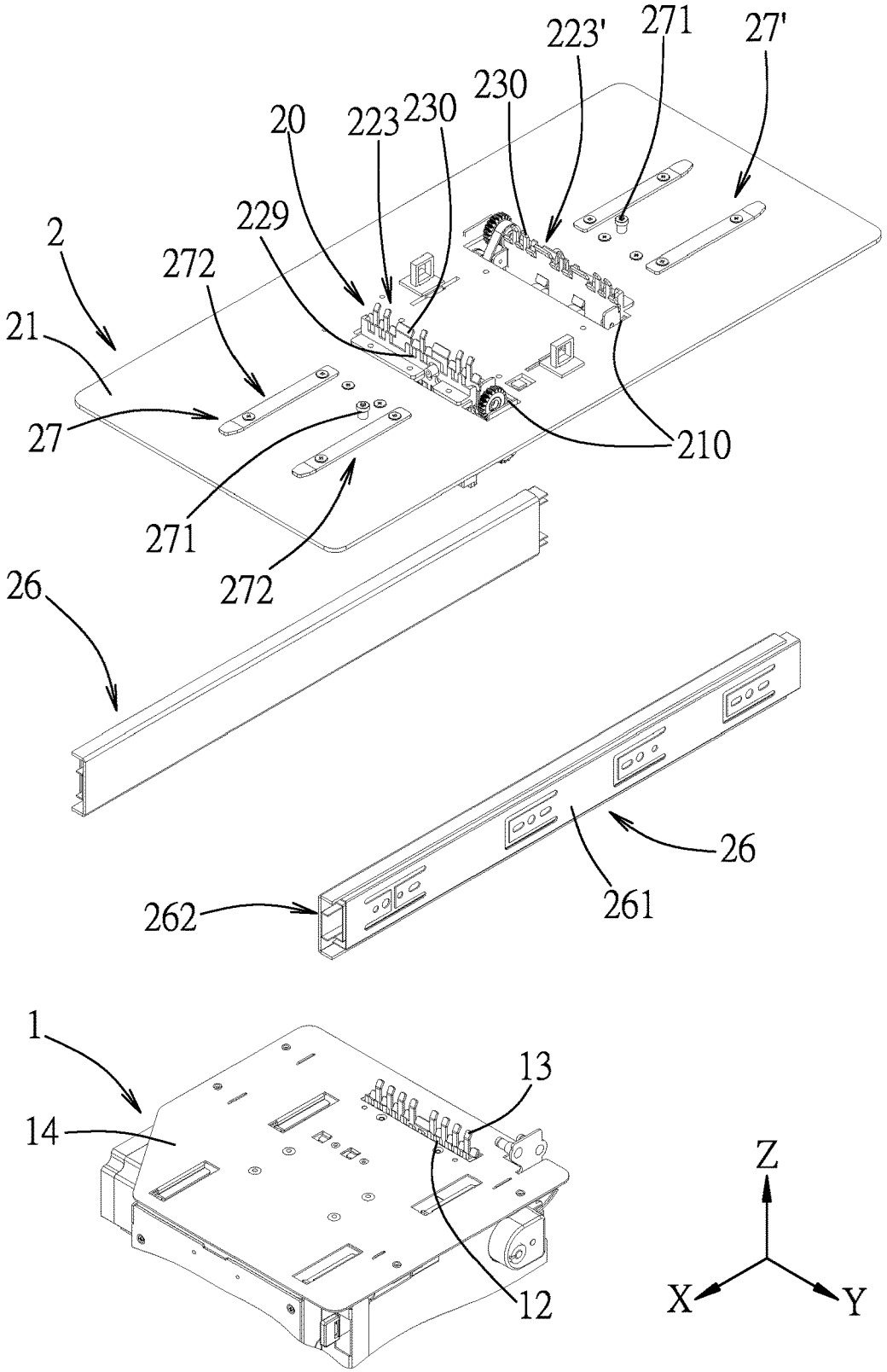
FIG. 3 is a fragmentary, exploded, perspective view of the first embodiment, illustrating an assembling relationship between the storage module and the connecting module.

In an embodiment shown in FIGS. 3 to 5, the connecting module 2 may further include the supporting plate 21 (mentioned above) and a pair of lower guiding rail units 26. The supporting plate 21 has an upward surface for supporting the first and second sheet processing modules 3, 3' thereon, and the downward surface (mentioned above) for the connecting frame assembly 20 to be mounted thereto. The supporting plate 21 is configured to permit access of the connecting frame assembly 20 to the first and second sheet processing modules 3, 3'. In an embodiment shown in FIG. 3, the supporting plate 21 is in the rectangular form, and has two long edges each extending in the front-and-rear direction (X).

Figure 23:
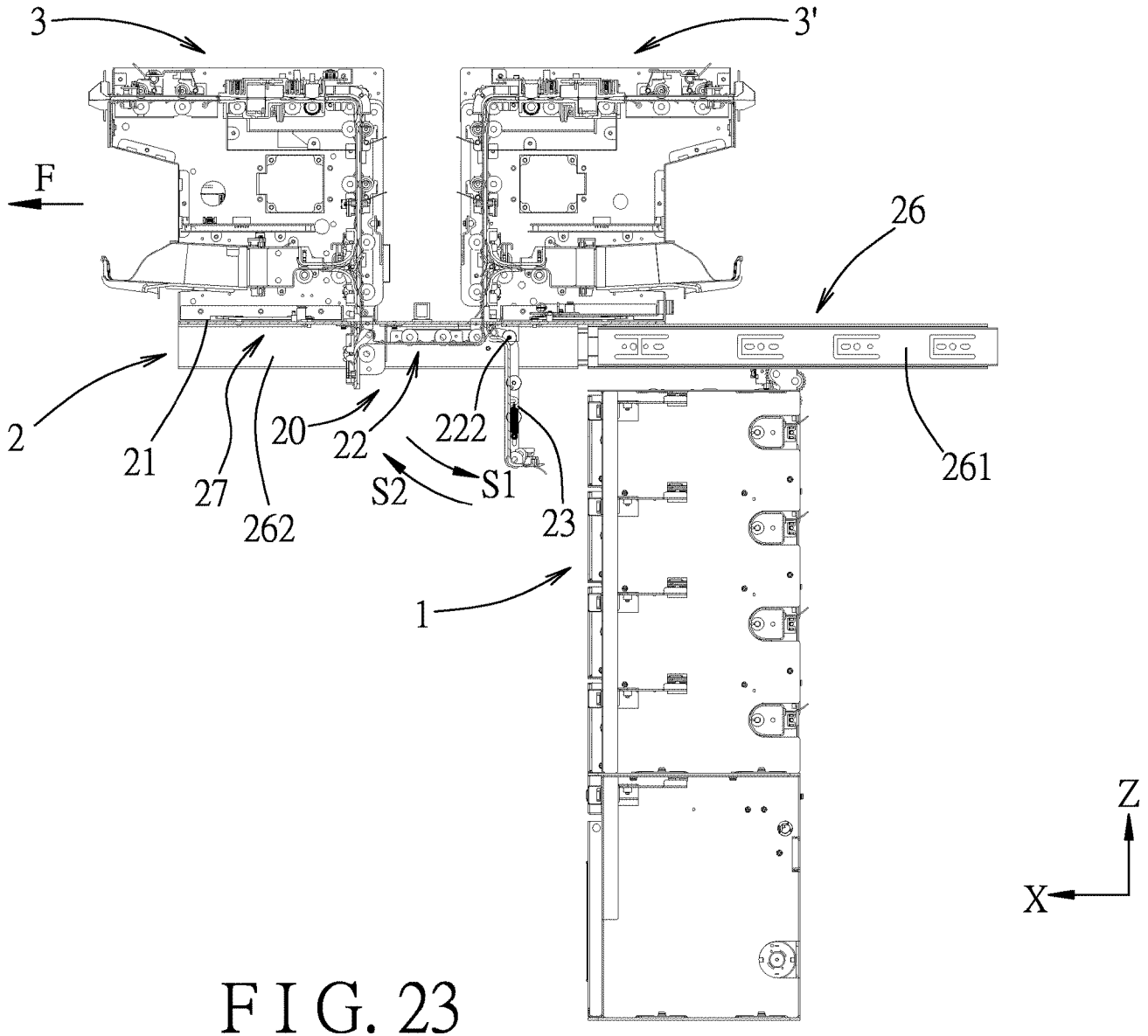
FIG. 23 is a partially cross-sectional view of the first embodiment illustrating the upper frame unit being exposed from the lower frame unit.

The lower guiding rail units 26 are mounted beneath the supporting plate 21 at opposite sides of the connecting frame assembly 20 so as to permit the supporting plate 21 to move relative to the storage module 1 in the front-and-rear direction (X) between a retracted position (i.e., a working position shown in FIGS. 1 and 2) and an extended position (i.e., a non-working position shown in FIG. 23). In the working position, sheet transport between the second communication port (C31) and a third interconnection port (S10) (described below) of the storage module 1 is permitted. In the non-working position, the sheet transport between the second communication port (C31) and the third interconnection port (S10) is forbidden.

In an embodiment shown in FIGS. 1 to 3, the lower guiding rail units 26 are disposed beneath the supporting plate 21, and are spaced apart from each other in the left-and-right direction (Y). Each of the lower guiding rail units 26 is disposed in proximity to the respective long edge of the supporting plate 21, and includes a fixed guiding rail 261 which may be screw-fixed to an inner surface of a machine casing (not shown), and a guided rail 262 which may be screw-fixed or welded to the downward surface of the supporting plate 21 so as to permit movement of the supporting plate 21 between the working position (FIGS. 1 and 2) and the non-working position (FIG. 23).

In an embodiment shown in FIGS. 3 to 5, the connecting frame assembly 20 includes an upper frame unit 22 which is mounted to the downward surface of the supporting plate 21, and a lower frame unit 23 which is hingedly mounted to the upper frame unit 22 for covering a lower side of the upper frame unit 22. In addition, the connecting module 2 may further include a lock mechanism 24 which is configured to releasably lock the upper and lower frame units 22, 23 together. When the supporting plate 21 is in the working position (FIG. 2), the upper and lower frame units 22, 23 are locked together by virtue of the lock mechanism 24. When the supporting plate 21 is in the non-working position (FIG. 23), the lock mechanism 24 is permitted to be actuated to release the lock between the upper and lower frame units 22, 23 to thereby allow turning of the lower frame unit 23.

In an embodiment shown in FIGS. 3 to 5, the upper frame unit 22 may include an upper frame 221 having an upper horizontal guide wall 225 and two upper sidewalls 226, a hinge shaft 222, and a second vertical guide wall 224. The upper horizontal guide wall 225 is mounted on the downward surface of the supporting plate 21. The upper sidewalls 226 are disposed at left and right sides of the upper horizontal guide wall 225 to be spaced apart from each other in the left-and-right direction (Y). The hinge shaft 222 extends in the left-and-right direction (Y) to interconnect rear ends of the upper sidewalls 226. The second vertical guide wall 224 is disposed to interconnect front ends of the upper sidewalls 226, and extends downwardly. A bottom portion of the second vertical guide wall 224 is in the form of guiding teeth which are displaced from each other in a left-and-right direction (Y).

Furthermore, the lower frame unit 23 may include a lower horizontal guide wall 231 for covering a lower side of the upper horizontal guide wall 225, two lower sidewalls 232, and a first vertical guide wall 233. The lower sidewalls 232 are disposed at left and right sides of the lower horizontal guide wall 231 to be spaced apart from each other in the left-and-right direction (Y), and respectively have rear ends each of which is pivotally connected to the hinge shaft 222 so as to permit the lower frame unit 23 to be hingedly mounted to the upper frame unit 22. The first vertical guide wall 233 extends downwardly from a front end of the lower horizontal guide wall 231 to interconnect front ends of the lower sidewalls 232 and is disposed rearwardly of and spaced apart from the second vertical guide wall 224 in the front-and-rear direction (X). A bottom portion of the first vertical guide wall 233 is in the form of guiding teeth displaced from each other in the left-and-right direction (Y). The first and second vertical guide walls 233, 224 together constitute a lower transfer member 236 (see FIG. 4) which is provided for passage of the sheet 9, and which defines the third transport channel (C3) with the second communication port (C31) at a bottom end of the transport channel (C3). Please note that because the upper and lower horizontal guide walls 225, 231 define therebetween a lower portion of the second transport channel (C2), and because the first and second vertical guide wall 233, 224 defines therebetween the lower juncture zone (C10) and the third transport channel (C3), the second and third transport channels (C2, C3) and the lower juncture zone (C10) can be opened when the lock between the lock between the upper and lower frames 221, 231 is released.

Figure 6:
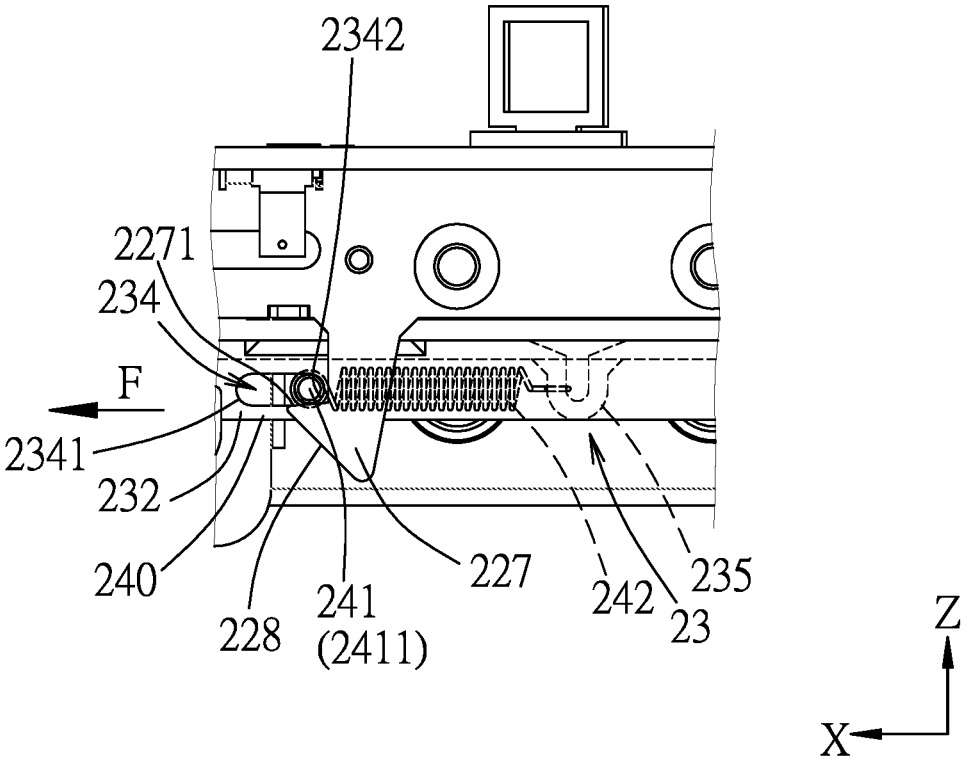
FIG. 6 is a fragmentary side view of the connecting module of the first embodiment, illustrating an engaging rod in a second engaging position.

In an embodiment shown in FIGS. 5 and 6, the lock mechanism 24 may include two holding pieces 240, an engaging rod 241, a first biasing member 242, and a hook member 227.

The two holding pieces 240 are separately mounted on the lower frame unit 23, and respectively have two elongated slots 234 each extending to terminate at a first slot end 2341 and a second slot end 2342. In an embodiment shown in FIGS. 5 and 6, each of the two holding pieces 240 may be integrally formed with a respective one of the lower sidewalls 232, and each of the elongated slots 234 extends in the front-and-rear direction (X) to terminate at the first and second slot ends 2341, 2342.

The engaging rod 241 extends lengthwise in the left-and-right direction (Y) through the elongated slots 234, and is slidably between a first engaging position and a second engaging position. In the first engaging position, the engaging rod 241 is in abutting engagement with the first slot ends 2341 of the elongated slots 234. In the second engaging position, as shown in FIG. 6, the engaging rod 241 is in abutting engagement with the second slot ends 2342 of the elongated slots 234. In an embodiment shown in FIGS. 5 and 6, the engaging rod 241 is disposed beneath the lower horizontal guide wall 231 of the lower frame unit 23.

The first biasing member 242 is disposed to bias the engaging rod 241 to the second engaging position. In an embodiment shown in FIGS. 5 and 6, the lock mechanism 24 may have two of the first biasing members 242 each of which is an extension spring, and each of which has two hook ends that hook respectively on a respective one of two rod end segment 2411 of the engaging rod 241 and a respective lug 235 formed on a lower surface of the lower horizontal guide wall 231, to thereby bias the engaging rod 241 to the second engaging position.

The hook member 227 extends downwardly from the upper frame unit 22, and is configured such that when the engaging rod 241 is in the second engaging position, the hook member 227 is permitted to be in hooking engagement with the engaging rod 241, and such that when the engaging rod 241 is moved toward the first engaging position against a first biasing force of the first biasing member(s) 242, the engaging rod 241 is disengaged from the hook member 227. In an embodiment shown in FIGS. 5 and 6, the lock mechanism 24 may have two of the hook members 227 each of which extends downwardly from the respective upper sidewall 226 for being disposed outboard of the respective lower sidewall 232, and each of which has a guiding region 228 and a retaining region 2271. In response to movement of the lower frame unit 23 to cover the lower side of the upper frame unit 22, movement of the engaging rod 241, which is guided by the guiding region(s) 228 of the hook member(s) 227 to move toward the first engaging position against the first biasing force, permits the engaging rod 241 to slip over the guiding region (s) 228 to thereby be retained by the retaining region(s) 2271 of the hook member(s) 227 by virtue of the first biasing force.

In an embodiment shown in FIGS. 3 and 4, the upper frame unit 22 of the connecting frame assembly 20 may further include a pair of first upper transport guides 229 which are reversely arranged on the supporting plate 21 in the front-and-rear direction (X), and which are disposed to border top portions of the first and second transport channels (C1, C2), respectively. In addition, the back transport guide 386 of each of the first and second sheet processing modules 3, 3' is spaced apart from a respective one of the first upper transport guides 229 in the front-and-rear direction (X). A bottom edge of the back transport guide 386 is disposed higher than a top edge of the respective first upper transport guide 229 by a second gap (G2) in an upright direction (Z).

In an embodiment shown in FIGS. 3 and 4, the first upper transport guides 229 are spaced apart from each other in the front-and-rear direction (X) and is fixed to the supporting plate 21. The upper frame unit 22 of the connecting frame assembly 20 may further include a pair of second upper transport guides 230. A front one of the second upper transport guides 230 is fixed between the front ends of the upper sidewalls 226 at a top side thereof, and is disposed rearwardly of and spaced apart from a front one of the first upper transport guides 229 in the front-and-rear direction (X) to constitute a first transfer member 223 which defines the first transport channel (C1) with an upper portion of the second vertical guide wall 224 and a front end of the upper horizontal guide wall 225. The first transport channel (C1) is in a straight form, and has the first interconnection port (C11) at a top end thereof. The second vertical guide wall 224 is disposed beneath the front one of the first upper transport guides 229.

Furthermore, a rear one of the second upper transport guides 230 is connected to a rear end of the upper horizontal guide wall 225 and fixed between the rear ends of the upper sidewalls 226 at the top side thereof, and is disposed forwardly of and spaced apart from a rear one of the first upper transport guides 229 to constitute a second upper transfer member 223' which defines the second transport channel (C2) with the upper and lower horizontal guide wall 225, 231. The second transport channel (C2) is reclined-L-shaped, and has the second interconnection port (C21) at a top end thereof. The first and second upper transfer member 223, 223' are reversely arranged and are spaced apart from each other in the front-and-rear direction (X) for receiving the sheets 9 from the first and second sheet processing modules 3, 3', respectively. A top portion of each of the first and second upper transport guides 229, 230 is in the form of guiding teeth which are displaced from each other in a left-and-right direction (Y). A top edge of each of the second upper transport guides 230 is disposed higher than a top edge of the respective first transport guide 229. In addition, the guiding teeth of the inner transport guide 317 of each of the first and second sheet processing modules 3, 3' are interdigitated with the guiding teeth of the top edge of a respective one of the first upper transport guides 229, and the guiding teeth of the back transport guide 386 of each of the first and second sheet processing modules 3, 3' are interdigitated with the guiding teeth of a respective one of the second upper transport guides 230.

In addition, the supporting plate 21 has two openings 210 for extension of the first and second upper transfer member 223, 223' so as to permit the access of the connecting frame assembly 20 to the first and second sheet processing modules 3, 3'.

Figure 10:
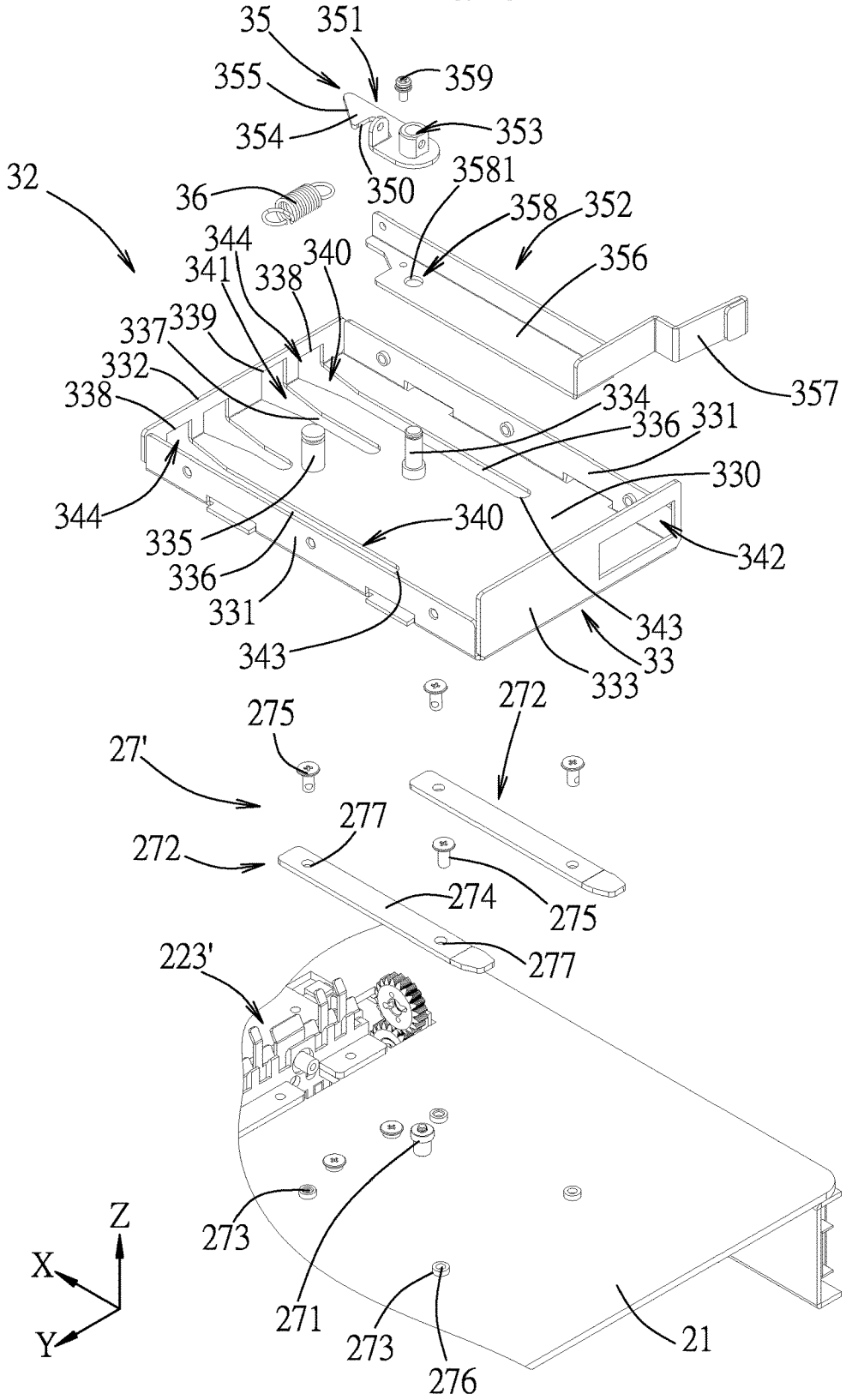
FIG. 10 is a fragmentary, exploded, perspective view of the locking mechanism, a guiding mechanism, and the connecting module in the first embodiment, illustrating an assembling relationship between the guiding mechanism and the locking mechanism.

In an embodiment shown in FIGS. 9 and 10, the sheet processing apparatus 100 may further include two locking mechanisms 32 (only one is shown) each of which is configured to lock a respective one of the first and second processing modules 3, 3' to the connecting module 2, and each of which includes a first engaged member 271 and a first fastening member 35.

The first engaged member 271 is mounted above the connecting frame assembly 20. In an embodiment shown in FIGS. 3 and 10, the first engaged member 271 is in form of a protuberance and is mounted on the upward surface of the supporting plate 21 to be disposed between a short edge of the supporting plate 21 and a respective one of the first and second upper transfer members 223, 223' in proximity to the respective one of the first and second upper transfer members 223, 223'.

The first fastening member 35 is mounted to the respective one of the first and second processing modules 3, 3' to be accessible from the operating side 301 of the respective one of the first and second processing modules 3, 3', and is configured to engage the first engaged member 271 for locking the respective one of the first and second processing modules 3, 3' to the connecting module 2 such that when the first fastening member 35 is actuated, the first fastening member 35 is permitted to disengage from the first engaged member 271.

Figure 11:
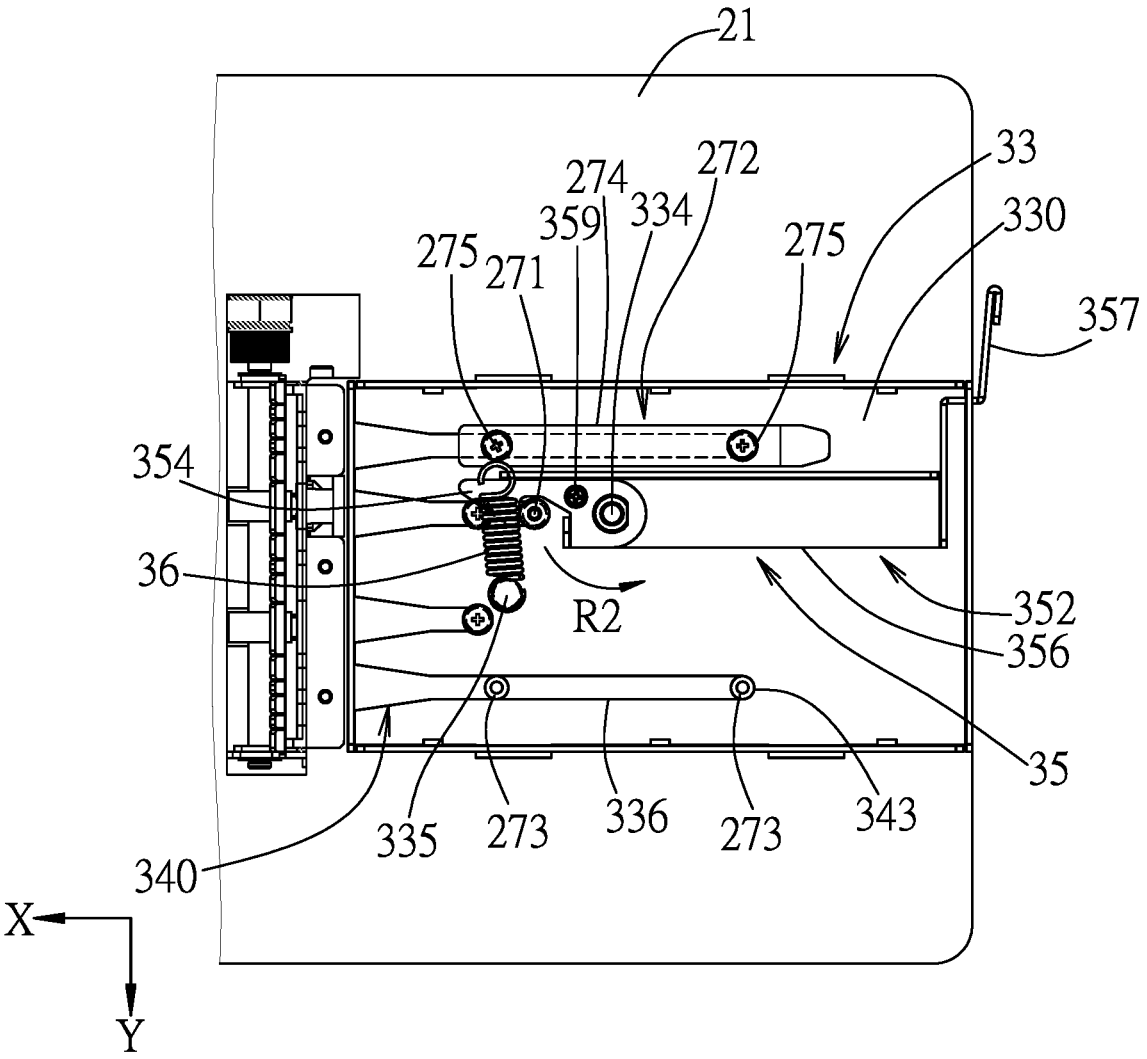
FIG. 11 is a fragmentary top view of the locking mechanism assembled on the connecting module in the first embodiment, illustrating a first weight segment of a first fastening member in a locked position.
Figure 17:
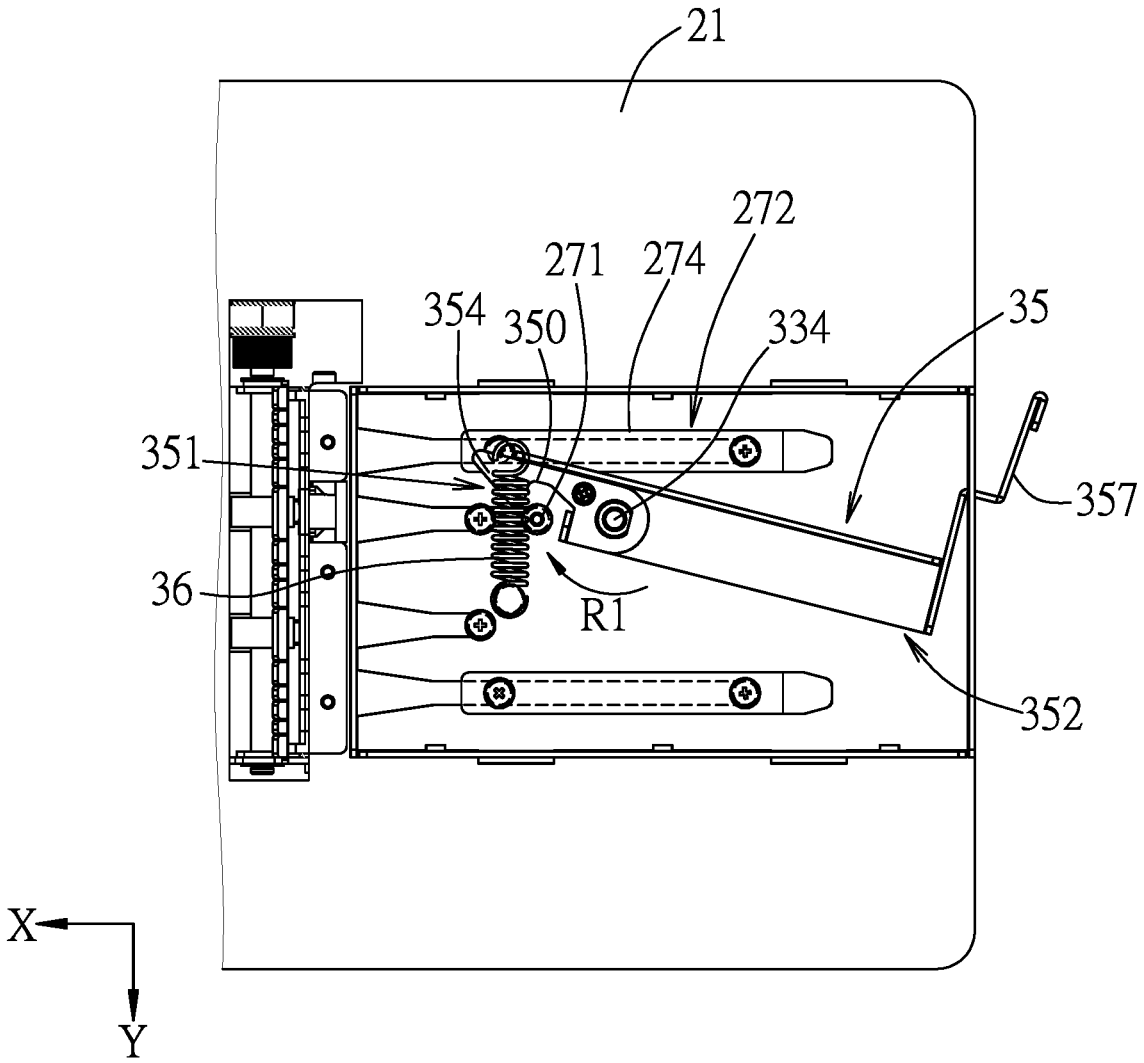
FIG. 17 is similar to FIG. 11, but illustrating the first weight segment of the first fastening member in an unlocked position.

In an embodiment shown in FIGS. 10 and 11, the first fastening member 35 is turnably mounted to the respective one of the first and second processing modules 3, 3', and has a first power segment 357, a first weight segment 354, and a first fulcrum region 358. The first power segment 357 is accessible from the operating side 301 of the respective one of the first and second processing modules 3, 3'. The first weight segment 354 has a hooking area 350. The first fulcrum region 358 is disposed between the first power and weight segments 357, 354. When the first power segment 357 is actuated to turn the first fastening member 35 relative to the respective one of the first and second processing modules 3, 3', the first weight segment 354 is moved from a locked position (FIG. 11) to an unlocked position (FIG. 17). In the locked position, the hooking area 350 of the first weight segment 354 is permitted to be in hooking engagement with the first engaged member 271. In the unlocked position, the first weight segment 354 is released from engagement with the first engaged member 271.

In addition, each of the first and second sheet processing modules 3, 3' further includes a first tray member 33 which is mounted beneath the main frame assembly 300, and which is disposed to permit the first fulcrum region 358 of the respective first fastening member 35 to be pivotally mounted thereon with the first power segment 357 disposed outside the first tray member 33. The first tray member 33 is configured to permit access of the hooking area 350 of the first weight segment 354 of the respective first fastening member 35 to the first engaged member 271. Each of the locking mechanisms 32 further includes a second biasing member 36 which is disposed on the first tray member 33 of a respective one of the first and second sheet processing modules 3, 3' to bias the first weight segment 354 of the first fastening member 35 to the locked position. In an embodiment shown in FIG. 9, the first tray member 33 is mounted beneath the main body 311 of the main frame assembly 300.

In an embodiment shown in FIG. 10, the first weight segment 354 further has an inclined area 355. In response to movements of the first and second sheet processing modules 3, 3' toward each other, the first engaged member 271 of each of the locking mechanisms 32 is permitted to slip over the inclined area 355 of the first weight segment 354 against a second biasing force of the second biasing member 36, to thereby be hooked by the hook area 350 of the first weight segment 354.

In an embodiment shown in FIGS. 10 and 11, the first fastening member 35 includes a hook piece 351 and a handle 352. The hook piece 351 has the first weight segment 354 and a sleeve portion 353. The handle 352 has the first power segment 357 and a pivotal segment 356 which are disposed distal from and proximate to the hook piece 351, respectively. The pivotal segment 356 extends lengthwise in the front-and-rear direction (X) to have a pivot hole 3581. The sleeve portion 353 and the pivotal segment 356 are overlapped to be secured to each other by a screw member 359 to constitute the first fulcrum region 358 having the pivotal hole 3581, and the first fulcrum region 358 is pivotally mounted to a first pillar stem 334 formed on the first tray member 33 of the respective one of the first and second sheet processing modules 3, 3'. The first power segment 357 is disposed outwardly of the respective first tray member 33 to be accessible from the operating side 301 of the respective one of the first and second processing modules 3, 3', and is connected to the pivotal segment 356 through an access opening 342 of the respective first tray member 33.

Furthermore, the first tray member 33 includes abase wall 330, two lateral walls 331, an inner wall 332, an outer wall 333, the first pillar stem 334, and a second pillar stem 335. The lateral walls 331 extend upwardly and respectively from left and right edges of the base wall 330 to be respectively screw-fastened to inner surfaces of the side plates 313 of the respective main frame assembly 300 (see FIG. 9). Each of the inner and outer walls 332, 333 extends upwardly from a respective one of inner and outer edges of the base wall 330. The first and second pillar stems 334, 335 are separately formed on the base wall 330. The outer wall 333 has the access opening 342.

Moreover, the second biasing member 36 is disposed on the first tray member 33 of the respective one of the first and second sheet processing modules 3, 3' to bias the first weight segment 354 of the first fastening member 35 to the locked position (FIG. 11). In an embodiment shown in FIG. 11, the second biasing member 36 may be an extension spring with two hook ends which respectively hook on the second pillar stem 335 and the hook piece 351.

In an embodiment shown in FIG. 10, the first tray member 33 is formed with a second elongated guided slot 341 configured to permit access of the hooking area 350 of the first weight segment 354 of the respective first fastening member 35 to the first engaged member 271, and to permit the first tray member 33 to be slidable relative to the connecting module 2.

In an embodiment shown in FIG. 10, the second elongated guided slot 341 includes an elongated slot region 337 which is formed in the base wall 330, and which extends in the front-and-rear direction (X), and an end slot region 339 which is formed in the inner wall 332.

In an embodiment shown in FIGS. 3, 10 and 20, the sheet processing apparatus 100 further includes a first guiding mechanism 27 and a second guiding mechanism 27' each of which is disposed to guide a respective one of the first and second sheet processing modules 3, 3' to engagingly slide relative to the connecting module 2 so as to permit the first and second sheet processing modules 3 to be removed respectively from the front and rear sides of the connecting module 2.

In an embodiment shown in FIGS. 3 and 10, each of the first and second guiding mechanisms 27, 27' includes a first elongated guided slot 340 and a first engaging rail unit 272.

The first elongated guided slot 340 is formed in the first tray member 33 of a respective one of the first and second sheet processing modules 3, 3', and extends in the front-and-rear direction (X). The first engaging rail unit 272 is mounted above the connecting frame assembly 20, and is configured to be retained in the first elongated guided slot 340 so as to guide movement of the first tray member 33 of the respective one of the first and second sheet processing modules 3, 3' relative to the connecting module 2.

In an embodiment shown in FIGS. 3 and 10, the first engaging rail unit 272 includes a pair of first guiding stems 273 and a first stop piece 274. The first guiding stems 273 are disposed on the upward surface of the supporting plate 21, and are spaced apart from each other in the front-and-rear direction (X). The first guiding stems 273 are configured to be retained in the first elongated guided slot 340. The first stop piece 274 is fixed on the first guiding stems 273 and is configured to abut against an upper tray surface of the first tray member 33 of the respective one of the first and second sheet processing modules 3, 3'.

In an embodiment shown in FIG. 10, each of the first guiding stems 273 defines a screw hole 276 with the supporting plate 21. The first stop piece 274 extends lengthwise in the front-and-rear direction (X), and has two through holes 277 for extension of the screw members 275, respectively. By registering the screw holes 276 of the first guiding stems 273 with the through holes 277 of the first stop piece 274, the first stop piece 274 can be fixed to first guiding stems 273 by virtue of two screw members 275.

In addition, the first elongated guided slot 340 has a first open end 344 and a first closed end 343 opposite to the first open end 344 in the front-and-rear direction (X) such that when the first open end 344 of the first elongated guided slot 340 is in alignment with the first guiding stems 273 of the first engaging rail unit 272, the first tray member 33 of the respective one of the first and second sheet processing modules 3, 3' is guided by the first guiding stems 273 of the first engaging rail unit 272 to permit an assembling movement of the respective one of the first and second sheet processing modules 3, 3' onto the upward surface of the supporting plate 21, and such that once the first closed end 343 of the first elongated guided slot 340 abuts against one of the first guiding stems 273 of the first engaging rail unit 272, the respective one of the first and second sheet processing modules 3, 3' is prevented from further assembling movement.

In an embodiment shown in FIGS. 3 and 10, the first and second guiding mechanisms 27, 27' are reversely arranged on the connecting module 2 in the front-and-rear direction (X). The first engaging rail unit 272 may be mounted on the upward surface of the supporting plate 21. The first elongated guided slot 340 includes an elongated slot region 336 which is formed in the base wall 330 of the respective first tray member 33, and which extends in the front-and-rear direction (X) away from the inner wall 332 to terminate at the first closed end 343, and an end slot region 338 which is formed in the inner wall 332 of the respective first tray member 33 to define the first open end 344 with the elongated slot region 336.

In an embodiment shown in FIGS. 3 and 10, each of the first and second guiding mechanisms 27, 27' includes two of the first engaging rail units 272 and two of the first elongated guided slots 340. The first engaging rail units 272 are disposed at left and right sides of the first engaged member 271 of the respective locking mechanism 32, and spaced apart from each other in the left-and-right directions (Y). The first elongated guided slots 340 are spaced apart from each other in the left-to-rear direction (Y) with the second elongated guided slot 341 provided therebetween.

Please note that with the provision of the first engaging rail unit(s) 272 and the first elongated guided slot(s) 340 in each of the first and second guiding mechanisms 27, 27', the respective one of the first and second sheet processing modules 3, 3' is less likely to wobble in the left-and-right direction (Y) during assembling or disassembling. Furthermore, because the first stop pieces 274 of each of the first and second guiding mechanisms 27, 27' abut against the upper tray surface of the respective first tray member 33, the respective one of the first and second sheet processing modules 3, 3' is less likely to wobble in the upright direction (Z) during assembling or disassembling.

As shown in FIGS. 2 and 4, the storage module 1 defines the third interconnection port (S10) for receiving the sheet 9 from the second communication port (C31), and a storage space 110 for storing the sheet 9 received from the third interconnection port (S10).

In an embodiment shown in FIGS. 2 and 3, the storage module 1 defines a second transport path (S) configured to transport the sheet 9 received from the third interconnection port (S10) to the storage space 110.

In an embodiment shown in FIGS. 3 and 4, the storage module 1 includes a first lower transport guide 12 disposed to border a top portion of the second transport path (S). The first vertical guide wall 233, which is disposed to border a bottom portion of the third transport channel (C3), is spaced apart from the first lower transport guide 12 in the front-and-rear direction (X). A bottom edge of the first vertical guide wall 233 is disposed higher than a top edge of the first lower transport guide 12 by a first gap (G1) in an upright direction (Z). Furthermore, top ends of the first and second transport channels (C1, C2) (i.e., the first and second interconnection ports (C1, C21)) are provided above a top plate 14 of the storage module 1, and a lower end of the third transport channel (C3) (i.e., the second communication port (C31)) is disposed for communication with the a top end of the second transport path (S) (i.e., the third interconnection port (S10)).

In an embodiment shown in FIGS. 1 to 4, the storage module 1 may further include a plurality of storage boxes 11 and a second lower transport guide 13. The storage boxes 11 are displaced from each other in an upright direction (Z), and each of the storage boxes 11 defines therein the storage space 110 for storing the sheet(s) 9. The second transport path (S) is communicated to the storage spaces 110 of the storage boxes 11, and is configured to transport the sheet 9 received from the third interconnection port (S10) to a selected one of the storage spaces 110 for storage, and to transport the sheet 9 stored in a selected one of the storage spaces 110 for drawing out the sheet 9. The first and second lower transport guides 12, 13 respectively have upper end segments disposed upwardly of the top plate 14 to define the third interconnection port (S10). The first lower transport guide 12 is spaced apart from and disposed forwardly of the second lower transport guide 13 in a front-and-rear direction (X) to cooperatively border the top portion of the second transport path (S).

A top edge of the second lower transport guide 13 is disposed higher than a top edge of the first lower transport guide 12. A top portion of each of the first and second lower transport guides 12, 13 is in the form of guiding teeth which are displaced from each other in a left-and-right direction (Y).

In an embodiment shown in FIG. 3 to 5, the guiding teeth of the second vertical guide wall 224 are interdigitated with the guiding teeth of the first lower transport guide 12, and the guiding teeth of the first vertical guiding wall 233 are interdigitated with the guiding teeth of the second lower transport guide 13.

Referring to FIGS. 2 and 17, it can be noted that when a maintenance staff intends to detach the second sheet processing module 3' from the connecting module 2 for repairing or troubleshooting, the maintenance staff may grip the first power segment 357 of the handle 352 of a rear one of the locking mechanisms 32, which is accessible from the operating side 301 of the second sheet processing module 3', to turn the first fastening member 35 in a first rotating direction (R1) shown in FIG. 17. At this point, the first weight segment 354 of the hook piece 351 is turned against the second biasing force of the second biasing member 36. When the first weight segment 354 is moved to the unlocked position (FIG. 17), the hooking area 350 of the first weight segment 354 is released from engagement with the first engaged member 271.

Figure 18:
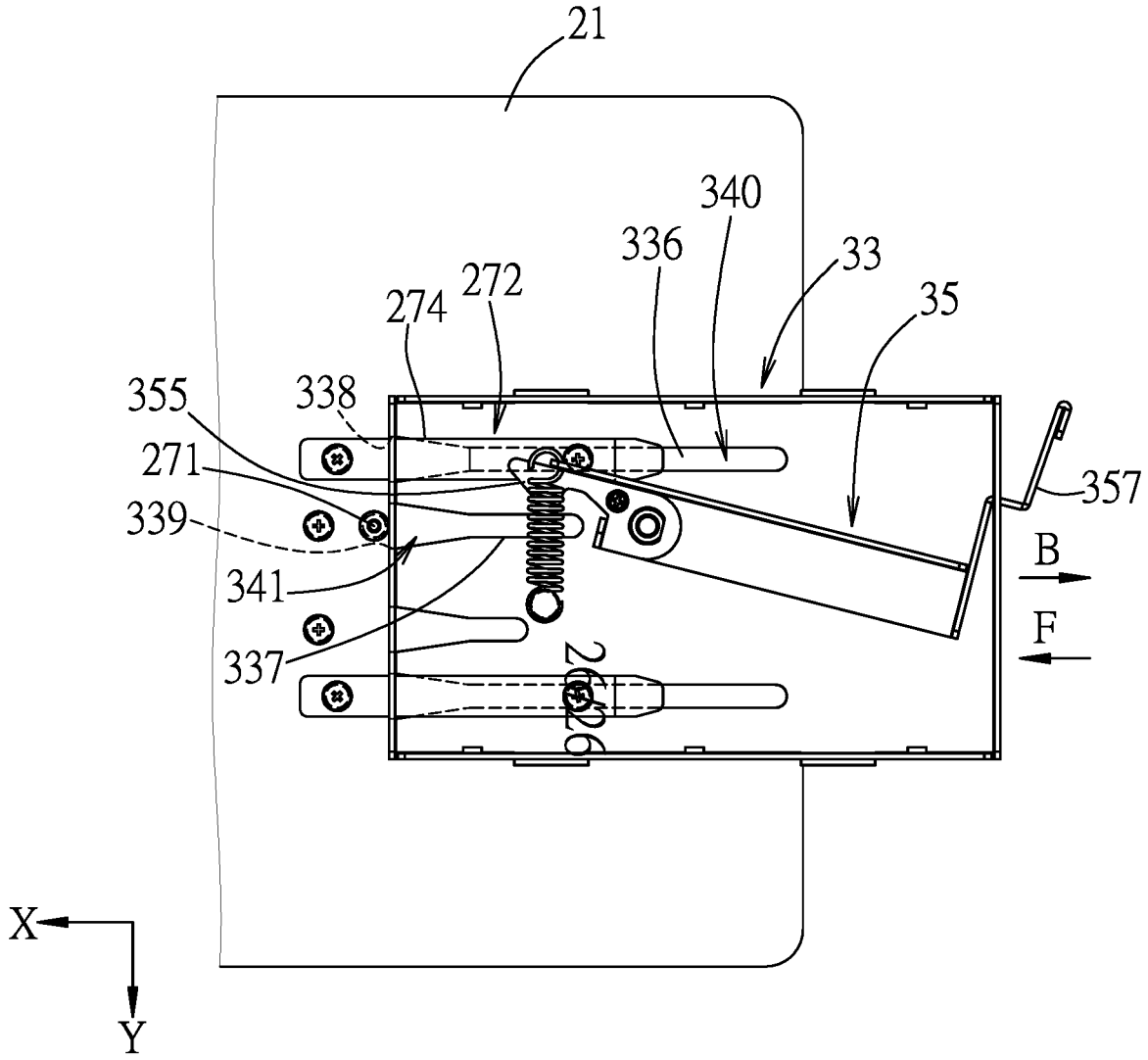
FIG. 18 is similar to FIG. 17 but illustrating a first tray member moved rearwardly.

Thereafter, the maintenance staff may grip the first power segment 357 of the handle 352 of the rear one of the locking mechanisms 32 to permit the first tray member 33 of the second sheet processing module 3' to slide rearwardly along an arrow (B) (see FIG. 18). During the sliding of the first tray member 33 of the second sheet processing module 3', the first elongated guided slot(s) 340 of the second guiding mechanism 27' will disengage from the first engaging rail unit (s) 272 via the end slot region(s) 338 of the first elongated guided slot(s) 340 (i.e., the first open end(s) 344 of the first elongated guided slot(s) 340), and the second elongated slot 341 will disengage from the first engaged member 271 of the rear one of the locking mechanisms 32 via the end slot region 339.

Figure 19:
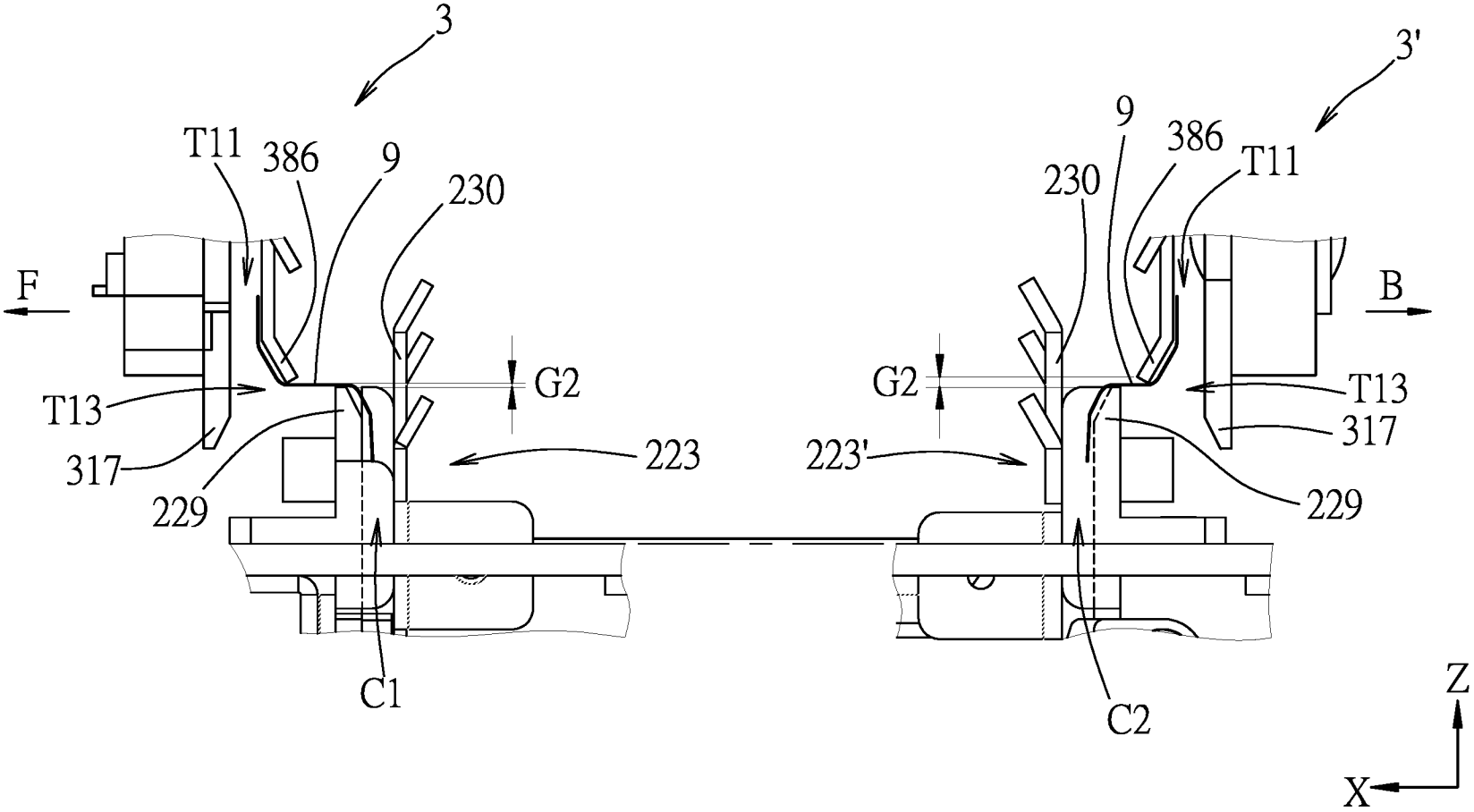
FIG. 19 is a fragmentary side view of the first embodiment, illustrating the bottom edges of the back transport guides of the first and second sheet processing modules moved forwardly and rearwardly over the top edges of the first upper transport guides, respectively.

Referring to FIG. 19, it can observed that the bottom edge of the back transport guide 386 is disposed higher than the top edge of the respective first upper transport guide 229 by the second gap (G2) in the upright direction (Z). If the sheet 9 is disposed between the first communication port (T13) at a bottom end of the first transport path (T1) and the second transport channel (C2), the back transport guide 386 of the second sheet processing module 3' may be driven to bring an upper half of the sheet 9 to move therewith rearwardly along an arrow (B). Once the bottom edge of the back transport guide 386 of the second sheet processing module 3' moves over the top edge of the first upper transport guide 229 of the second transfer member 223', the sheet 9 will deform to be partially received in the second gap (G2).

After the bottom edge of the back transport guide 386 of the second sheet processing module 3' and the top edge of the first upper transport guide 229 of the second transfer member 223' are spaced apart in the front-and-rear direction (X) by a predetermined distance, the sheet 9 will be moved away from the first communication port (T13) to be disposed between the first and second upper transport guides 229, 230 of the second transfer member 223' or between the inner and back transport guides 317, 386 of the second sheet processing module 3'. By virtue of the tenacity of the sheet 9 and the provision of the second gap (G2), the tearing of the sheet 9 can be prevented during movement of the second sheet processing module 3' relative to the second transfer member 223', and the torn sheet 9, if any, can be prevented from being unremovably jammed between the first transport path (T11) and the second transport channel (C2), to thereby prevent the jamming of the second sheet processing module 3' or prevent the failure of the parts of the second sheet processing module 3'.

Referring to FIGS. 18 and 20, after the first engaged member 271 of the rear one of the locking mechanisms 32 and the first engaging rail unit(s) 272 of the second guiding mechanism 27' are completely disengaged from the respective first tray member 33 via the end slot region 339 and the end slot region(s) 338, respectively, the second sheet processing module 3' can be detached from the connecting module 2 for removal from the non-shown machine casing. Thereafter, the maintenance staff may release the first power segment 357 of the handle 352 of the rear one of the locking mechanisms 32 to permit the first weight segment 354 of the hook piece 351 to return back to the locked position by virtue of the second biasing force of the second biasing member 36.

As shown in FIG. 20, if the maintenance staff intends to detach the first sheet processing module 3 from the connecting module 2 for repairing or troubleshooting, the first weight segment 354 (see FIG. 17) of a front one of the locking mechanisms 32 may be is displaced to the unlocked position by turning of the first fastening member 35 of the front one of the locking mechanisms 32 in a manner similar to those for the rear one of the locking mechanisms 32. For detaching the first sheet processing module 3, the first tray member 33 of the first sheet processing module 3 can be pulled to slide forwardly along an arrow (F) opposite to the arrow (B).

To wit, the first and second sheet processing modules 3, 3' can be detached from the connecting module 2 by respectively pulling the first tray members 33 of the first and second sheet processing modules 3, 3' in opposite directions along the arrows (F, B). Similarly, in the case that the sheet 9 is disposed between the first transport path (T11) and the first transport channel (C1) (see FIG. 19), with the provision of the second gap (G2) between the bottom edge of the back transport guide 386 of the first sheet processing module 3 and the top edge of the first upper transport guide 229 of the first transfer member 223, the tearing of the sheet 9 can be prevented during forward movement of the first sheet processing module 3 relative to the first transfer member 223, and the torn sheet 9, if any, can be prevented from being unremovably jammed between the first transport path (T11) and the first transport channel (C1) to thereby prevent the jamming of the first sheet processing module 3 or prevent the failure of the parts of the first sheet processing module 3.

Figure 21:
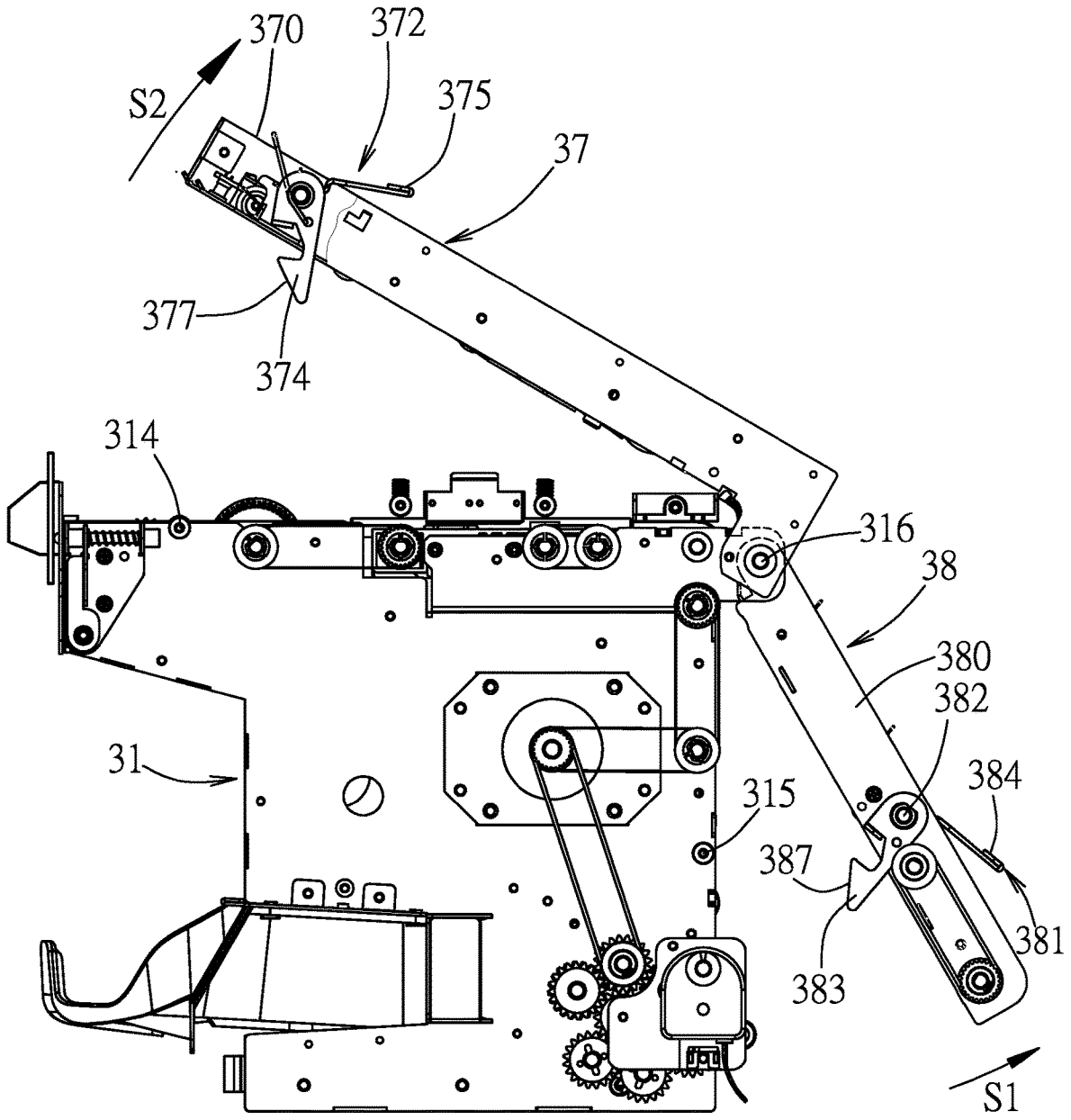
FIG. 21 is similar to FIG. 12 but illustrating the upper and back fastening mechanisms respectively in upper and back unfastening positions to permit turning of top and back frames.

As shown in FIG. 21, the maintenance staff may open the top frame unit 37 or the back frame unit 38 for any one of the first and second processing modules 3, 3' which is detached from the connecting module 2 and removed from the non-shown machine casing. To open the top frame unit 37, the maintenance staff may pull the upper release plate 375 of the upper fastening mechanism 372 upwardly to turn the upper hook members 374 and the upper axle 373 in a first turning direction (S1) about an axis of the upper axle 373 against a biasing force of the upper torsion springs 376. When moved to an upper unfastening position, each of the upper hook members 374 is disengaged from the respective first protuberance 314. Next, the top frame 370 can be turned relative to the main frame 31 in a second turning direction (S2) opposite to the first turning direction (S1) about an axis of the pivot axle 316 to thereby open the top frame 370. Thereafter, the maintenance staff may release the upper release plate 375 to permit the upper hook members 374 to return back to the upper fastening position by virtue of the biasing force of the upper torsion springs 376. When the top frame 370 is opened to expose the upper horizontal portion of the first transport path (T11), the maintenance staff may repair the elements (such as identifying unit 30) therein or may remove the sheet 9 jammed therein. Because the first and second sheet processing modules 3, 3' can be easily removed from the connecting module 2 and the non-shown machine casing, the maintenance therefor is convenient and time-saving.

To open the back frame unit 38, the staff may pull the back release plate 384 of the back fastening mechanism 381 upwardly to permit turning of the back hook members 383 and the back axle 382 in the first turning direction (S1) about an axis of the back axle 382 against a biasing force of the back extension springs 385. When moved to a back unfastening position, each of the back hook members 383 is disengaged from the respective second protuberance 315. Next, the back frame 380 can be turned relative to the main frame 31 in the first turning direction (S1) about the axis of the pivot axle 316 to thereby open the back frame 380. Thereafter, the maintenance staff may release the back release plate 384 to permit the back hook members 383 to return back to the back fastening position by virtue of the biasing force of the back extension springs 385. When the back frame 380 is opened to expose the lower vertical portion of the first transport path (T11), the maintenance staff may repair the elements therein or may remove the sheet 9 jammed therein.

Figure 12:
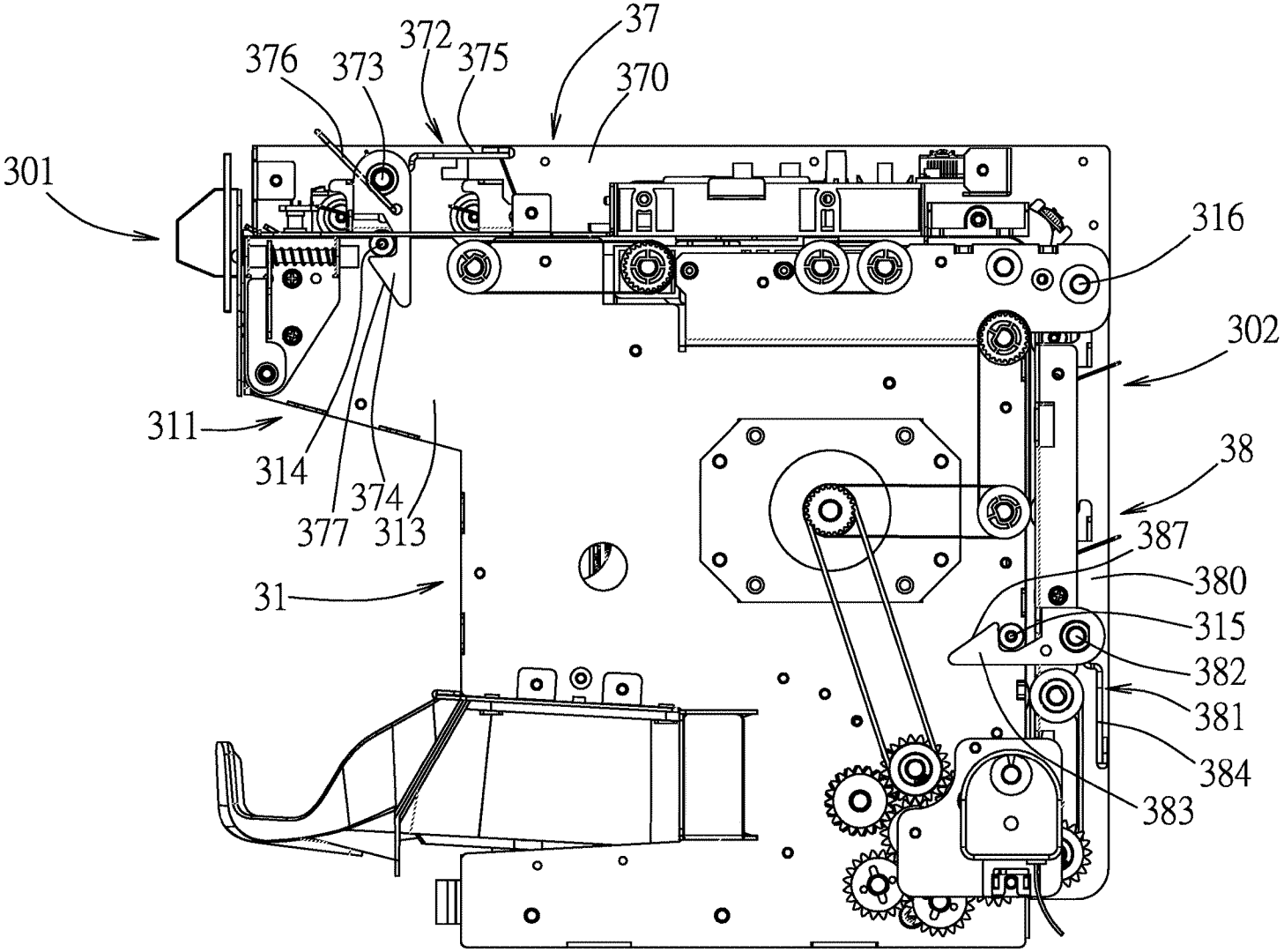
FIG. 12 is a side view of the main frame assembly of one of the first and second sheet processing modules in the first embodiment, illustrating the upper and back fastening mechanisms respectively in upper and back fastening positions.

As shown in FIGS. 12 and 21, to close the top frame 370, the maintenance staff may push down the top frame 370 to permit the turning of the top frame 370 in the first turning direction (S1). When inclined surfaces 377 of the upper hook members 374 are respectively in contact with the first protuberances 314, the upper hook members 374, together with the upper axle 373, will turn against the biasing force of the upper torsion springs 376, to permit the first protuberances 314 to respectively slip over the inclined surfaces 377 of the upper hook members 374 to thereby respectively bring the upper hook members 374 into hooking engagement with the first protuberances 314 by virtue of the biasing force of the upper torsion springs 376. With the provision of the upper fastening mechanism 372, the top frame 370 can be quickly and conveniently opened from or locked to the main frame 31.

To close the back frame 380, the maintenance staff may push the back frame 380 inwardly to permit the turning of the back frame 380 in the second turning direction (S2). When inclined surfaces 387 of the back hook members 383 are respectively in contact with the second protuberances 315, the back hook members 383, together with the back axle 382, will turn against the biasing force of the back extension springs 385, to permit the second protuberances 315 to respectively slip over the inclined surfaces 387 of the back hook members 383 to thereby respectively bring the back hook members 383 into hooking engagement with the second protuberances 315 by virtue of the biasing force of the back extension springs 385. With the provision of the back fastening mechanism 381, the back frame 380 can be quickly and conveniently opened from or locked to the main frame 31.

As shown in FIGS. 17, 18, and 20, to assemble the second sheet processing module 3' onto the connecting module 2, the second sheet processing module 3' is disposed to permit the end slot region(s) 338 and the end slot region 339 formed in the first tray member 33 to be in alignment with the first engaging rail unit(s) 272 of the second guiding mechanism 27' and the first engaged member 271 of the rear one of the locking mechanisms 32. Thereafter, the second sheet processing module 3' is pushed to slide forwardly on the supporting plate 21 along the arrow (F). During the sliding of the second sheet processing module 3', the first engaging rail unit(s) 272 of the second guiding mechanism 27' is(are) engaged in the elongated slot region(s) 336 of the first elongated guided slot(s) 340 via the end slot region(s) 338 (i.e., the first open end(s) 344), and the first engaged member 271 is engaged in the second elongated guided slot 341 of the respective first tray member 32 via the end slot region 339. When the inclined area 355 of the hook piece 351 of the rear one of the locking mechanism 32 is brought into contact with the first engaged member 271, the first fastening member 35 will turn in the first rotating direction (R1) shown in FIG. 17 against the second biasing force of the second biasing member 36, to permit the first engaged member 271 to slip over the inclined area 355 of the hook piece 351 to thereby allow the first fastening member 35 to turn back in a second rotating direction (R2) opposite to the first rotating direction (R1), and to bring the hooking area 350 of the first weight segment 354 into hooking engagement with the first engaged member 271 by virtue of the second biasing force of the second biasing member 36.

In addition, as shown in FIGS. 2 and 11, during the sliding of the second sheet processing module 3', once the first weight segment 354 of the first fastening member 35 of the rear one of the locking mechanism 32 is in hooking engagement with the first engaged member 271, the first close end(s) 343 of the first elongated slot(s) 340 will abut against the first guiding stem(s) 273 of the first engaging rail unit(s) 272 so as to stop the sliding of the second sheet processing module 3'.

As shown in FIG. 20, to assemble the first sheet processing module 3 onto the connecting module 2, the first sheet processing module 3 is pushed to slide rearwardly on the supporting plate 21 along the arrow (B). To wit, the first and second sheet processing modules 3, 3' can be assembled onto the connecting module 2 from the opposite directions along the arrows (B, F). With the provision of the locking mechanisms 32 and the first and second guiding mechanism 27, 27', the first and second sheet processing modules 3, 3' can be quickly and conveniently assembled on or detached from the connecting module 2.

As shown in FIGS. 2 and 23, with the provision of the lower guiding rail units 26 mounted beneath the supporting plate 21, the supporting plate 21 can be pulled out from the retracted position (i.e., the working position shown in FIG. 2) to the extended position (i.e., the non-working position shown in FIG. 23) for repairing or troubleshooting the connecting module 2. In operation, the maintenance staff may simply pull the first sheet processing module 3 inside the non-shown machine casing along an arrow (F) shown in FIG. 23. Because the first sheet processing module 3 is locked on the connecting module 2 through the front one of the locking mechanisms 32 and the first guiding mechanism 27, the pulling movement of the first sheet processing module 3 will cause the forward movement of the supporting plate 21 and the guided rails 262 of the lower guiding rail units 26 relative to the fixed guiding rails 261 of the lower guiding rail units 26.

Figure 22:
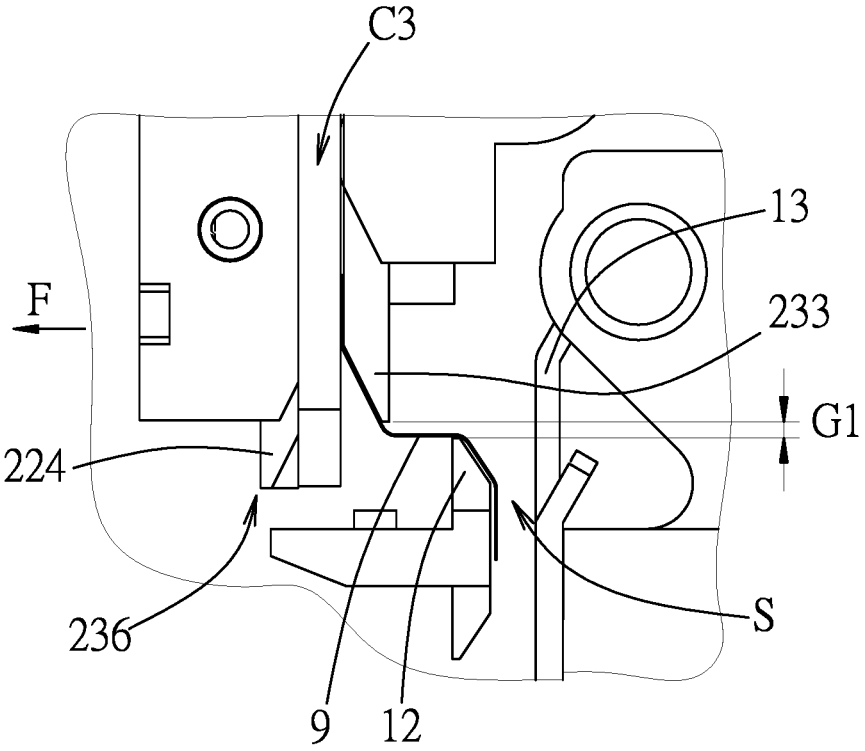
FIG. 22 is a fragmentary side view of the first embodiment illustrating the bottom edge of the first vertical guide wall moved over the top edge of the first lower transport guide.

As shown in FIG. 22, the bottom edge of the first vertical guide wall 233 and the top edge of the first lower transport guide 12 define the first gap (G1) in the upright direction (Z). Therefore, if the sheet 9 is disposed between the second transport path (S) and the third transport channel (C3), the first vertical guide wall 233 may be driven to bring an upper half of the sheet 9 to move therewith forwardly along the arrow (F). Once the bottom edge of the first vertical guide wall 233 moves over the top edge of the first lower transport guide 12, the sheet 9 will deform to be partially received in the first gap (G1). After the bottom edge of the first vertical guide wall 233 and the top edge of the first lower transport guide 12 are spaced apart in the front-and-rear direction (X) by a predetermined distance, the sheet 9 will be moved away from the third transport channel (C3) to be disposed between the first and second lower transport guides 12, 13 or between the first and second vertical guide walls 233, 224. By virtue of the tenacity of the sheet 9 and the provision of the first gap (G1), the tearing of the sheet 9 can be prevented during movement of the lower transfer member 236 relative to the first and second lower transport guides 12, 13, and the torn sheet 9, if any, can be prevented from being unremovably jammed between the second transport path (S) and the third transport channel (C3), to thereby prevent the jamming of the lower transfer member 236 or prevent the failure of the related parts.

When the supporting plate 21 is moved to the extended position (i.e., the non-working position shown in FIG. 23), the maintenance staff may remove the sheet jammed between the first and second lower transport guides 12, 13. In addition, the first sheet processing module 3 may be detached from the connecting module 2 for repairing or troubleshooting.

Furthermore, as shown in FIGS. 6 and 23, when the supporting plate 21 is moved to the extended position (the non-working position), the lower frame unit 23 and the lock mechanism 24 will not be shielded by the storage module 1. Thus, the maintenance staff can push the engaging rod 241 to move the engaging rod 241 toward the first engaging position against the first biasing force of the first biasing member(s) 242. When the engaging rod 241 is moved away from the second engaging position, the engaging rod 241 is disengaged from the hook member(s) 227 so as to permit the lower frame unit 23 to turn in the first turning direction (S1) about an axis of the hinge shaft 222, to thereby open the lower frame unit 23. Thereafter, when the engaging rod 241 is released, the engaging rod 241 is biased to the second engaging position by virtue of the first biasing force of the first biasing member(s) 242. At this point, the maintenance staff can repair the elements inside the first, second, and third transport channels (C1, C2, C3), or remove the sheet 9 jammed inside the connecting frame assembly 20.

Further referring to FIGS. 6 and 23, it can be noted that the maintenance staff may push the lower frame unit 23 in the second turning direction (S2) upwardly to close the lower frame unit 23. When the guiding region(s) 228 of the hook member(s) 227 is(are) in contact with the engaging rod 241, the engaging rod 241 will be forced to slide toward the first engaging position against the first biasing force of the first biasing member (s) 242, so as to permit the engaging rod 241 to slip over the guiding region (s) 228 to thereby bring the hook member (s) 227 into hooking engagement with the engaging rod 241 by virtue of the first biasing force of the first biasing member(s) 242. With the provision of the lock mechanism 24, the lower frame unit 23 can be quickly and conveniently opened from or locked to the upper frame unit 22.

As shown in FIGS. 2 and 4, because the first and second sheet processing modules 3, 3' are reversed arranged with the back sides 302 thereof facing each other, a user can selectively operate one of the first and second sheet processing modules 3, 3' at the operating side 301 for drawing out or storing the sheet 9. Alternatively, two users can respectively operate the first and second sheet processing modules 3, 3' at different sides of the sheet processing apparatus 100 for drawing out or storing the sheet 9. Furthermore, because the first and second sheet processing modules 3, 3' are assembled on and detached from the connecting module 2 at two different sides, when one of the first and second sheet processing modules 3, 3' is in maintenance, the other one of the first and second sheet processing modules 3, 3' can be operated by a user from the operating side 301. In addition, after gripping the first power segment 357 to turn the first weight segment 354 of the first fastening member 35 to the unlocked position (FIG. 17), the first power segment 357 can be pulled by the maintenance staff to permit sliding of the respective one of the first and second processing modules 3, 3' relative to the connecting module 2 for detaching. Besides, the re-assembling can be easily achieved by the sliding back of the respective one of the first and second processing modules 3, 3' onto the supporting plate 2.

With the provision of the first, second, and third transport channels (C1, C2, C3) inside the connecting frame assembly 20 of the connecting module 2, the first and second sheet processing modules 3, 3' can share the same storage module 1. Hence, the sheet processing apparatus 100 may have simpler structure and be produced at a reduced cost. Furthermore, by reversely arranging the first and second sheet processing modules 3, 3', which have the same height and which have the back sides 302 thereof facing each other, on the connecting module 2, the connecting frame assembly 20 may have simpler designed structure for the first, second, and third transport channels (C1, C2, C3). In other embodiments, the first and second sheet processing modules 3, 3', may have different heights, and the length of the first transport channel (C1) or the length of a vertical portion of the second transport channel (C2) may be adjusted for permitting the connecting module 2 to be connected to both of the first and second sheet processing modules 3, 3'.

The other object of the disclosed embodiments is to provide a cash payment terminal for consumers to pay for their order for their selected products/services (e.g., meals and movies).

For example, the disclosed sheet processing apparatus 100 may be implemented with multiple media kiosks. These systems may be implemented on walls or pillars. Through ticket booths or information booths (kiosks), consumers may select related products/services (e.g., meals and movie tickets) to generate orders and checkout.

The disclosed sheet processing apparatus 100 may support two kiosks at both sides at the same time. Those two kiosks can share the same storage module 1 through the disclosed sheet processing apparatus 100, so that a crowd attempting to make payment may be dispersed, while the business owner only needs to purchase one storage module 1 for every two kiosks.

The detailed structures of the storage module 1 might not be considered to be an inventive part of the present invention, but usually it amounts to a lot of hardware expenses for the business owner, depending on the situation. For example, each currency denomination will need the respective storage box 11 and a respective examining module to detect counterfeit currency. If the present invention is implemented, for example, in a food court, because the food court serves a much higher volume of customers, the sheet processing apparatus 100 might need more storage boxes 11 in one storage module 1.

In recent years, mobile payment is being adopted all over the world as a payment method in different payment systems. The other object of the disclosed embodiments is to provide a cash payment terminal for supporting payment systems in case the customers should want to pay in cash (physical currency) as an alternative to mobile payment. In addition to the food court, the present invention could also be implemented in a pharmacy, hospital, shop, convenience store, etc. When supporting payment systems in case the customers should want to pay in cash, the present invention can also offer the business owner an option to increase the customers handling capacity while sharing only one storage module 1 between two of the cash payment terminal.

Figure 24:
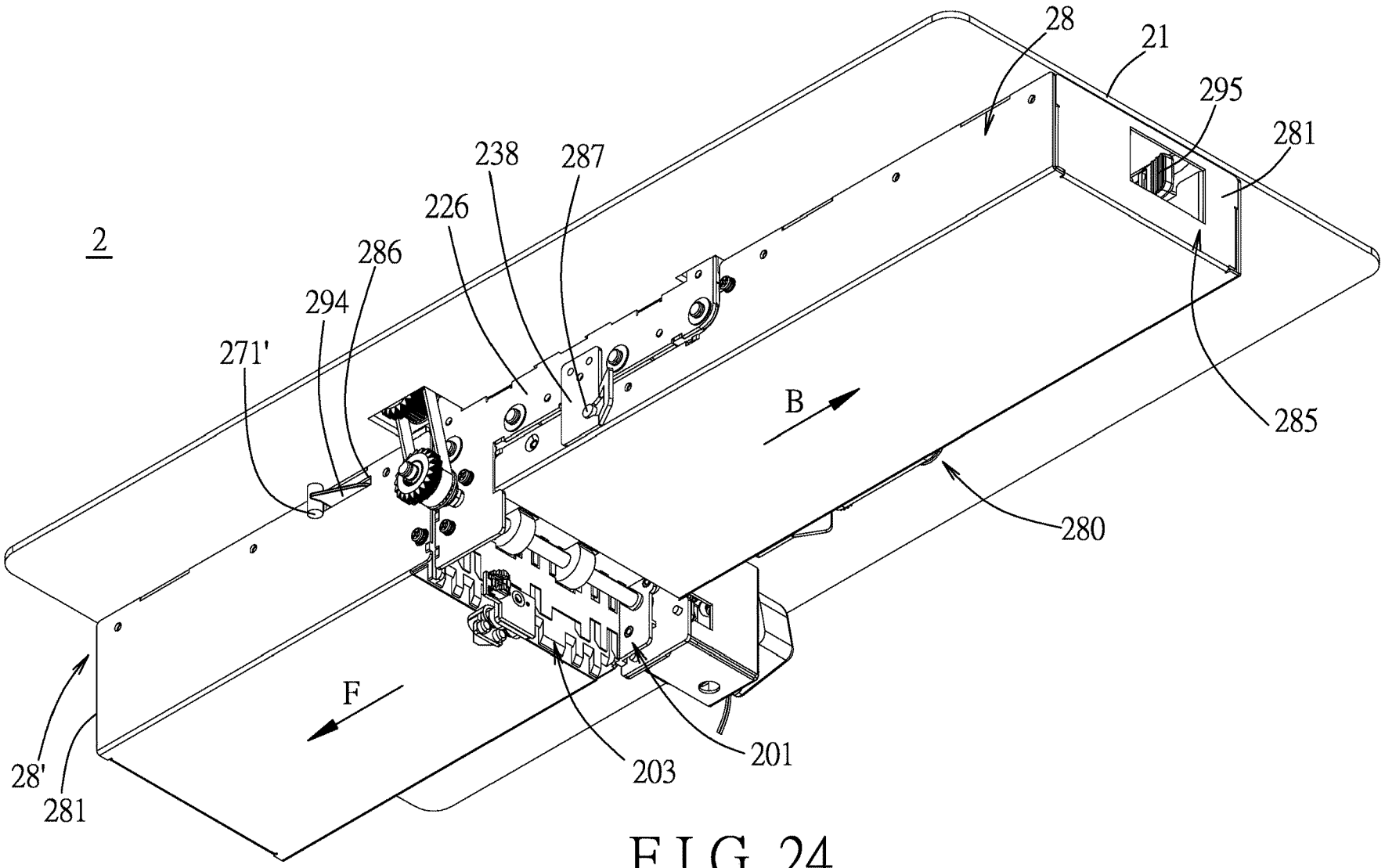
FIG. 24 is a perspective view of a connecting module of a sheet processing apparatus according to a second embodiment of the disclosure.
Figure 25:
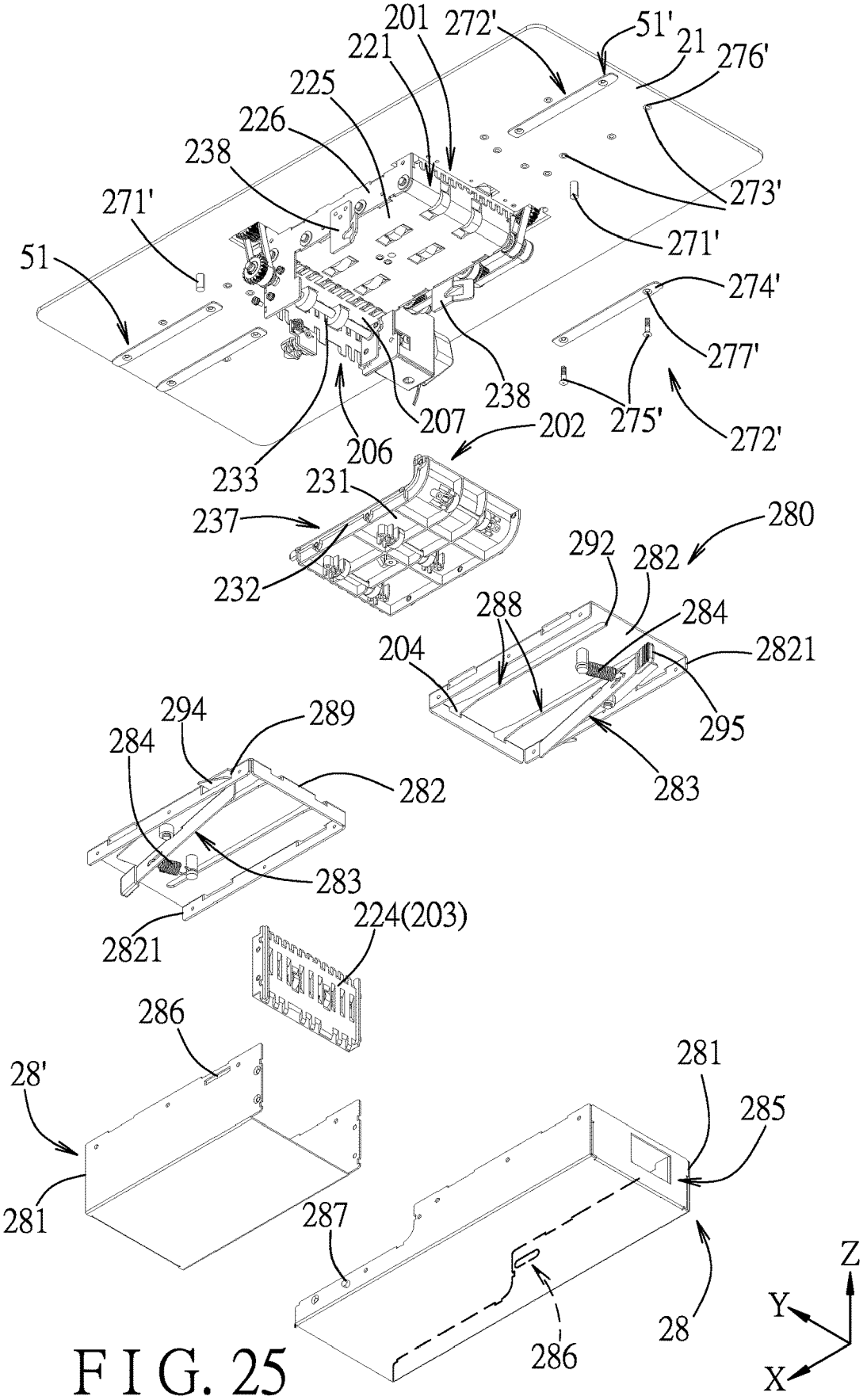
FIG. 25 is a partly exploded perspective view of the connecting module of the second embodiment.

FIGS. 24 and 25 illustrate a sheet processing apparatus 100 according to a second embodiment of the disclosure. The second embodiment is similar to the first embodiment except for the connecting module 2.

In the second embodiment, the lock mechanism 24 and the lower guiding rail units 26 are omitted. The connecting frame assembly 20 includes a non-movable portion 201, a first movable portion 202, and a second movable portion 203 opposite to the first movable portion 202 in the front-and-rear direction (X). The non-movable portion 201 is non-movably mounted to the downward surface of the supporting plate 21. The first and second movable portions 202, 203 are disposed to be movable relative to the supporting plate 21.

In an embodiment shown in FIG. 25, the non-movable portion 201 includes the upper frame 221, the first and second upper transfer members 223, 223' (shown in FIG. 3), and an angled plate 206. The upper frame 221 has the upper horizontal guide wall 225 and the two upper sidewalls 226. The angled plate 206 has the first vertical guide wall 233 which is spaced apart from the first moveable portion 202, and an additional horizontal guide wall 207 which may be screw-fastened between the upper sidewalls 226 to be spaced apart from the upper horizontal guide wall 225. The first movable portion 202 includes a cover plate 237 having the lower horizontal guide wall 231 and the lower sidewalls 232. The lower horizontal guide wall 231 defines the second transport channel (C2), together with the upper horizontal guide wall 225 and the additional horizontal guide wall 207. The second movable portion 203 includes the second vertical guide wall 224.

In the second embodiment, the connecting module 2 further includes a bracket assembly 280, a third guiding mechanism 51, and a fourth guiding mechanism 51'. The bracket assembly 280 is disposed between the connecting frame assembly 20 and the storage module 1, and is configured to permit access of the connecting frame assembly 20 to the storage module 1. The bracket assembly 280 includes a first bracket unit 28 and a second bracket unit 28', each of which is configured to retain a respective one of the first and second movable portions 202, 203. The third and fourth guiding mechanisms 51, 51' are disposed beneath the downward surface of the supporting plate 21 respectively at two opposite sides of the non-movable portion 201. Each of the third and fourth guiding mechanisms 51, 51' is configured to guide a respective one of the first and second bracket units 28, 28' to engagingly slide relative to the supporting plate 21 between an inward position and an outward position. In the inward position, as shown in FIG. 24, the respective one of the first and second movable portions 202, 203 is assembled to the non-movable portion 201. In the outward position, the respective one of the first and second movable portions 202, 203 is disassembled from the non-movable portion 201.

In an embodiment shown in FIG. 25, the first and second bracket units 28, 28' are disposed at two opposite sides of the first vertical guide wall 233, and each of the first and second bracket units 28, 28' includes a retaining bracket 281, and a second tray member 282. The retaining bracket 281 is configured for retaining therein the respective one of the first and second movable portions 202, 203. The second tray member 282 is mounted to an upper side of the retaining bracket 281 to move with the retaining bracket 281. In addition, each of the third and fourth guiding mechanisms 51, 51' includes an elongated guided slot 288 and a second engaging rail unit 272'. The elongated guided slot 288 is formed in the second tray member 282 of a respective one of the first and second bracket units 28, 28', and extends to be elongated in the front-and-rear direction (X). The second engaging rail unit 272' is mounted on the downward surface of the supporting plate 21, and is configured to be retained in the elongated guided slot 288 so as to guide movement of the respective one of the first and second bracket units 28, 28' relative to the supporting plate 21.

In an embodiment shown in FIG. 25, the second tray member 282 may be screw-fastened to the retaining bracket 281. In addition, the lower sidewalls 232 of the cover plate 237 may be respectively screw-fastened to two lateral walls of the retaining bracket 281 of the first bracket unit 28 so as to permit the first bracket unit 28 to retain the cover plate 237 (i.e., the first movable portion 202). The second vertical guide wall 224 may be screw-fastened to the retaining bracket 281 of the second bracket units 28' so as to permit the second bracket unit 28' to retain the second vertical guide wall 224 (i.e., the second movable portion 203).

Figure 26:
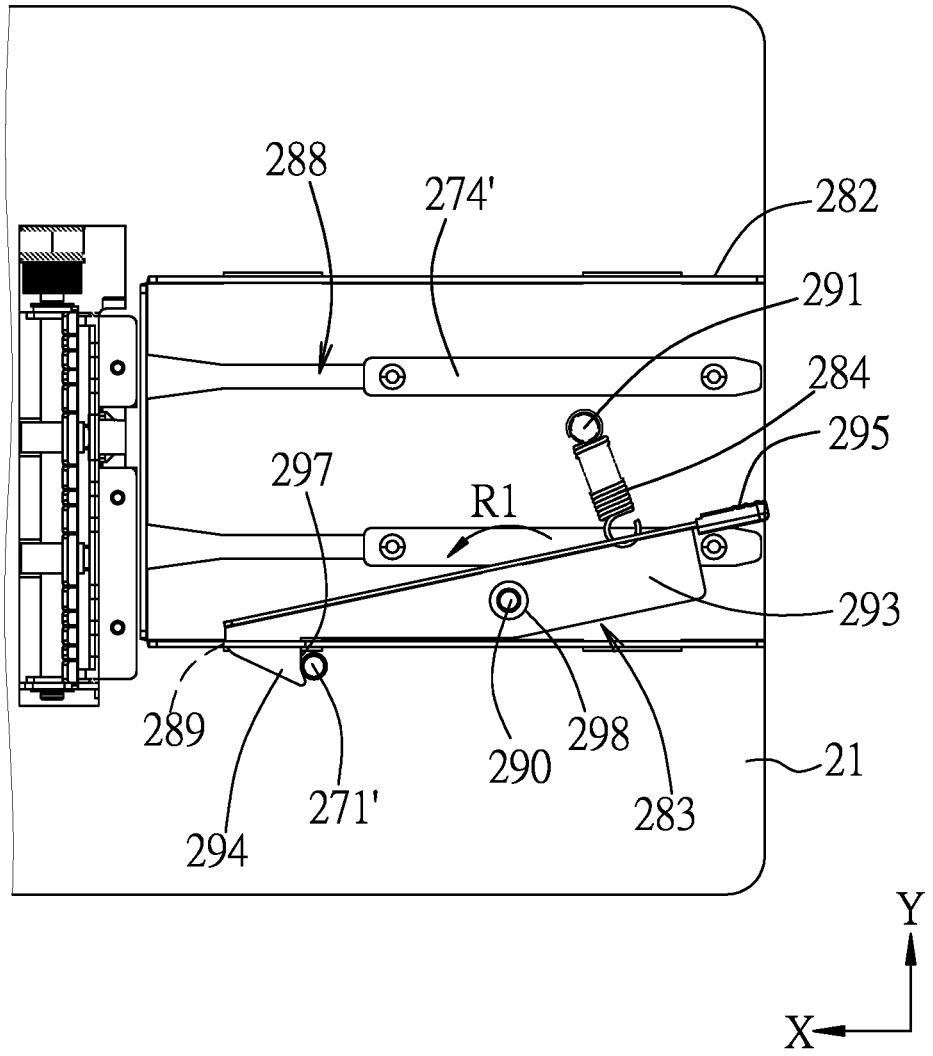
FIG. 26 is a fragmentary bottom view of the second embodiment, illustrating a second fastening member in a locked position.

In an embodiment shown in FIGS. 25 and 26, the second engaging rail unit 272' includes a pair of second guiding stems 273' and a second stop piece 274'. The second guiding stems 273' are disposed on the downward surface of the supporting plate 21, and are spaced apart from each other in the front-and-rear direction (X). The second guiding stems 273' are configured to be retained in the elongated guided slot 288. The second stop piece 274' is fixed on the second guiding stems 273' and is configured to abut against a lower tray surface of the respective second tray member 282. Furthermore, the elongated guided slot 288 has an open end 204 and a closed end 292 opposite to the open end 204 in the front-and-rear direction (X) such that when the open end 204 is in alignment with the second guiding stems 273', the second tray member 282 of the respective one of the first and second bracket units 28, 28' is guided by the second guiding stems 273' to permit an assembling movement of the respective one of the first and second bracket units 28, 28' on the downward surface of the supporting plate 21, and such that once the closed end 292 abuts against one of the second guiding stems 273', the assembling movement of the respective one of the first and second bracket units 28, 28' is stopped at the inward position shown in FIG. 24.

In an embodiment shown in FIG. 25, each of the second guiding stems 273' defines a screw hole 276' with the supporting plate 21. The second stop piece 274' extends lengthwise in the front-and-rear direction (X), and has two throughholes 277' for extension of the screw members 275', respectively. By registering the screw holes 276' of the second guiding stems 273' with the through holes 277' of the second stop piece 274', the second stop piece 274' can be fixed to second guiding stems 273' by virtue of two screw members 275'.

In an embodiment shown in FIGS. 25 and 26, each of the third and fourth guiding mechanisms 51, 51' may include two of the elongated guided slots 288 which are spaced apart from each other in the left-and-right direction (Y), and two of the second engaging rail units 272' which are spaced apart from each other in the left-and-right direction (Y).

Figure 27:
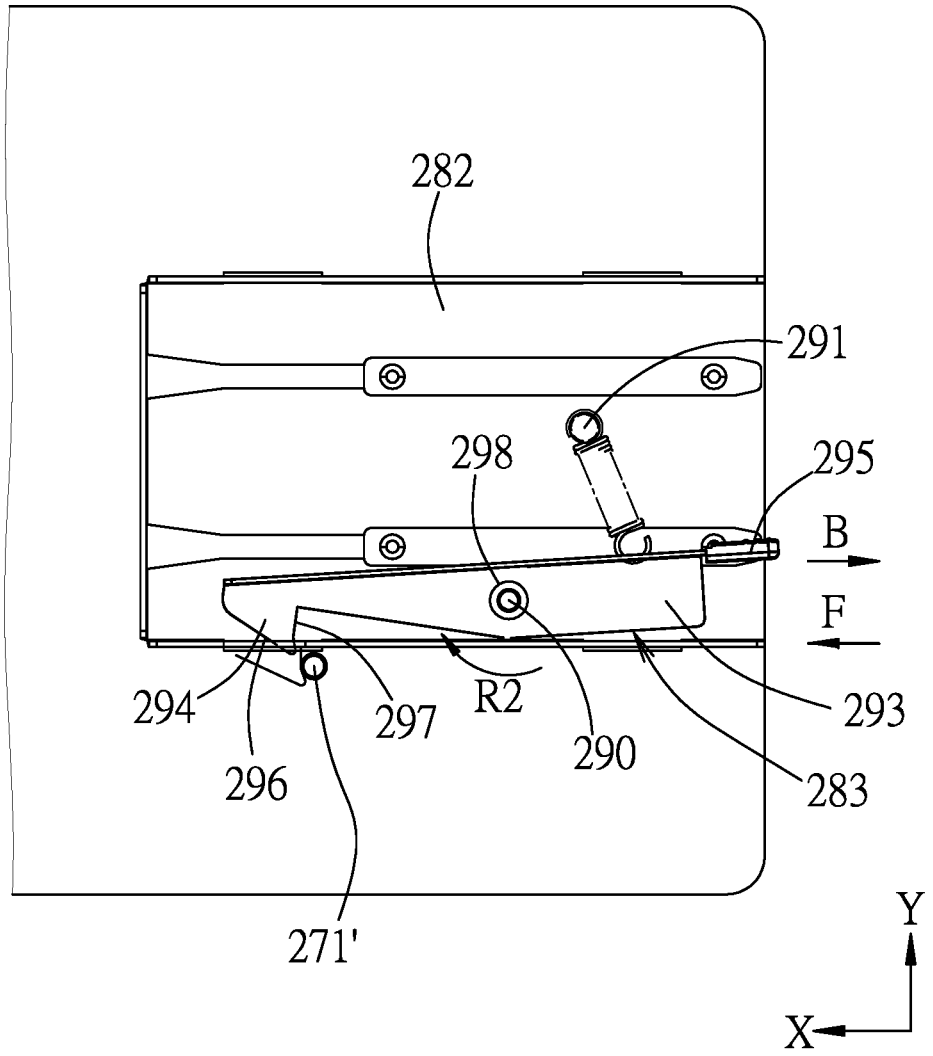
FIG. 27 is similar to FIG. 26, but illustrating the second fastening member in an unlocked position.

In an embodiment shown in FIGS. 25 and 26, the connecting module 2 may further include a pair of second engaged members 271', a pair of second fastening members 283, and a pair of third biasing members 284. The second engaged members 271' are separately mounted on the downward surface of the supporting plate 21 in positions corresponding to the first and second brackets 28, 28', respectively. Each of the second fastening members 283 has a second power segment 295 for manually operation, a second weight segment 294 with a hook area 297, and a second fulcrum region 298 which is pivotally mounted on the second tray member 282 of a respective one of the first and second bracket units 28, 28', and which is disposed between the second power and weight segments 295, 294 such that when the second power segment 295 is actuated to turn the second fastening member 283 relative to the respective second tray member 282, the second weight segment 294 is moved from a locked position to an unlocked position. In the locked position, as shown in FIG. 26, the hook area 297 of the second weight segment 294 is permitted to be in hooking engagement with the respective second engaged member 271'. In the unlocked position, as shown in FIG. 27, the second weight segment 294 is released from engagement with the respective second engaged member 271'. Each of the third biasing members 284 is disposed on the respective second tray member 282 to bias the second weight segment 294 of the respective second fastening member 283 to the locked position.

In an embodiment shown in FIGS. 25 and 26, each of the first and second bracket units 28, 28' has a pivotal pillar 290 and a pillar stem 291 which are separately formed on the lower tray surface of the second tray member 282. The second fulcrum region 298 of each the second fastening members 283 is pivotally mounted on the pivotal pillar 290 of the respective one of the first and second bracket units 28, 28'. Each of the third biasing members 284 may be an extension spring with two hook ends which respectively hook on the respective pillar stem 291 and a segment 293 of the respective second fastening members 283 located between the second power segment 295 and the second fulcrum region 298.

In an embodiment shown in FIG. 25, the retaining bracket 281 may have an access opening 285, and the second tray member 282 has a cutout portion 2821 in communication with the access opening 285. Thus, from the connecting module 2 and beneath the operating side 301 of each of the first and second sheet processing modules 3, 3' shown in FIG. 2, the maintenance staff may access the second power segment 295 of the respective second fastening member 283 through the access opening 283 and the cutout portion 2821 of the respective one of the first and second bracket units 28, 28' so as to move the respective second weight segment 294 to the unlocked position (FIG. 27) from the locked position (FIG. 26).

In an embodiment shown in FIGS. 24 to 26, each of the second engaged members 271' is in form of a protuberance, and is mounted on the downward surface of the supporting plate 21 to be disposed outboard of a respective one of the first and second bracket units 28, 28'. The retaining bracket 281 may have a first lateral hole 286, and the second tray member 282 may have a second lateral hole 289 which is in alignment with the first lateral hole 286 so as to permit access of the hook area 297 of the respective second fastening members 283 to the respective second engaged member 271 through the first and second lateral holes 286, 289.

In an embodiment shown in FIGS. 24 and 25, the connecting module 2 may further include a pair of retained stems 287 (only one is shown) and a pair of retaining plates 238. The retained stems 287 are respectively formed on left and right surfaces of the retaining bracket 281 of the first bracket unit 28. The retaining plates 238 are respectively mounted on the upper sidewalls 226, and are configured to respectively retain the retained stems 287 when the first bracket unit 28 is in the inward position shown in FIG. 24.

As shown in FIGS. 24, 25, and 27, to detach the first movable portion 202 (i.e., the cover plate 237) from the non-movable portion 201, the maintenance staff may grip the second power segment 295 of the respective second fastening member 283 to turn the respective second fastening member 283 in the second rotating direction (R2) about the respective pivotal pillar 290 against a third biasing force of the respective biasing member 284. The maintenance staff may pull the first bracket unit 28, together with the first movable portion 202, rearwardly along the arrow (F) by gripping the second power segment 295 of the respective second fastening member 283 when the respective weight segment 294 is moved to the unlocked position (FIG. 27) to disengage from the respective second engaged member 271'. During the pulling of first bracket unit 28, the second engaging rail unit(s) 272' may be removed from the elongated guided slot(s) 288 through the open end(s) 204 thereof, and the retained stems 287 may be detached respectively from the retaining plates 238, so as to remove the first bracket unit 28 and the first movable portion 202 from the non-movable portion 201. As such, the maintenance staff may repair the elements inside the second transport channel (C2) as shown in FIG. 4, or remove the sheet 9 jammed therein.

After the maintenance, for assembling the first movable portion 202 back onto the non-movable portion 201, the first bracket unit 28 is pushed to slide forwardly along the arrow (F). During the sliding of the first bracket unit 28, the second engaging rail unit(s) 272' may slide into the elongated guided slot(s) 288 via the open end(s) 204 thereof. When an inclined area 296 of the second weight segment 294 of the respective second fastening member 283 is brought into contact with the corresponding second engaged member 271', the second fastening member 283 will turn in the second rotating direction (R2) about the pivotal pillar 290 against the third biasing force of the respective biasing member 284, to permit the second engaged member 271' to slip over the inclined area 296 of the second fastening member 283 to thereby allow the second fastening member 35 to turn back in the first rotating direction (R2), and to bring the hooking area 297 of the second weight segment 294 into hooking engagement with the corresponding second engaged member 271' by virtue of the third biasing force of the respective biasing member 284. At this point, the closed end(s) 292 of the elongated slot(s) 288 is(are) brought into abutment against the second guiding stem(s) 273' of the respective second engaging rail unit(s) 272' so as to stop the first bracket unit 28 at the inward position.

To detach the second movable portion 203 (i.e., the second vertical guide wall 224) from the non-movable portion 201, the maintenance staff may pull the second bracket unit 28', together with the second movable portion 203, forwardly along the arrow (B) by actuating the respective second fastening member 283 in a manner similar to that for detaching the first movable portion 202. As such, the maintenance staff may repair the elements inside the first and third transport channels (C1, C3) as shown in FIG. 4, or remove the sheet 9 jammed therein.

The second bracket unit 28' can be detached from the supporting plate 21 by being pulled forwardly along the arrow (F), and assembled onto the supporting plate 21 by being pushed rearwardly along the arrow (B). The first bracket unit 28 can be detached from the supporting plate 21 by being pulled rearwardly along the arrow (B), and assembled onto the supporting plate 21 by being pushed forwardly along the arrow (F). Therefore, the provision of the first and second bracket units 28, 28' is useful and convenient for the maintenance for the connecting module 2.

In sum, in each embodiment for the sheet processing apparatus 100, with the design(s) of the locking mechanisms 32 and the first and second guiding mechanisms 27, 27', each of the first and second sheet processing modules 3, 3' can be detachably assembled to the connecting module 2 in a simple manner, and can be removed from the non-shown machine casing for repairing and troubleshooting. As such, the detaching, assembling, repairing and troubleshooting for each of the first and second sheet processing modules 3, 3' is convenient and time-saving. Besides, by arranging the first and second sheet processing modules 3' 3' with the same height on the connecting module 2 in a back-to-back manner, an accommodation space for the first and second sheet processing modules 3' 3' inside the non-shown machine casing may be reduced. A user can selectively operate one of the first and second sheet processing modules 3, 3' at the operating side 301 for drawing out or storing the sheet 9. Alternatively, two users can respectively operate the first and second sheet processing modules 3, 3' at different sides of the sheet processing apparatus 100 for drawing out or storing the sheet 9.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A sheet processing apparatus comprising:

a first sheet processing module and a second sheet processing module which are reversely arranged, each of said first and second sheet processing modules including a main frame assembly which defines an entrance port for receiving a sheet, a first communication port, and a first transport path for transporting the sheet received from said entrance port to said first communication port, and an identifying unit disposed to identify the sheet on said first transport path for admission of the sheet qualified by said identifying unit to said first communication port;

a connecting module configured for connecting said first and second sheet processing modules in such a manner that at least one of said first and second sheet processing modules is detachably mounted on said connecting module, said connecting module including a connecting frame assembly which defines a first interconnection port and a second interconnection port, each of which is disposed to receive the sheet from said first communication port of a respective one of said first and second sheet processing modules, and a second communication port, and a first diverter mechanism which is mounted to said connecting frame assembly, and which is configured to permit sheet transport between said second communication port and a selected one of said first and second interconnection ports; and a storage module defining a third interconnection port for receiving the sheet from said second communication port, and a storage space for storing the sheet received from said third interconnection port, wherein said connecting frame assembly further defines a lower juncture zone, a first transport channel and a second transport channel, each of which extends from a respective one of said first and second interconnection ports to said lower juncture zone, and a third transport channel which extends from said second communication port to said lower juncture zone;

said first diverter mechanism includes a diverter block which is disposed in said lower juncture zone and which is switchable between a first block position, where said diverter block is disposed to block said second transport channel to permit sheet transport between said first and third transport channels, and a second block position, where said diverter block is disposed to block said first transport channel to permit sheet transport between said second and third transport channels;

said storage module defines a second transport path configured to transport the sheet received from said third interconnection port to said storage space;

said connecting module further includes a supporting plate having an upward surface for supporting said first and second sheet processing modules thereon, and a downward surface for said connecting frame assembly to be mounted thereto, said supporting plate being configured to permit access of said connecting frame assembly to said first and second sheet processing modules, and a pair of lower guiding rail units which are mounted beneath said supporting plate at opposite sides of said connecting frame assembly so as to permit said supporting plate to move relative to said storage module in the front-and-rear direction between a working position, where sheet transport between said second communication port and said third interconnection port is permitted, and a non-working position, where the sheet transport between said second communication port and said third interconnection port is forbidden;

said connecting frame assembly includes an upper frame unit which is mounted to said downward surface of said supporting plate, and a lower frame unit which is hingedly mounted to said upper frame unit for covering a lower side of said upper frame unit; and said connecting module further includes a lock mechanism, which is configured to releasably lock said upper and lower frame units together such that when said supporting plate is in the working position, said upper and lower frame units are locked together by virtue of said lock mechanism, and such that when said supporting plate is in the non-working position, said lock mechanism is permitted to be actuated to release the lock between said upper and lower frame units to thereby allow turning of said lower frame unit.

* * * * *